US008875719B2

(12) United States Patent
Gueret

(10) Patent No.: US 8,875,719 B2
(45) Date of Patent: Nov. 4, 2014

(54) DEVICE FOR COMBING AND/OR BRUSHING EYELASHES AND/OR EYEBROWS, AND/OR FOR APPLYING MAKEUP THERETO

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 12/852,182

(22) Filed: Aug. 6, 2010

(65) Prior Publication Data

US 2010/0294297 A1 Nov. 25, 2010

Related U.S. Application Data

(62) Division of application No. 10/377,629, filed on Mar. 4, 2003, now Pat. No. 7,789,094.

(60) Provisional application No. 60/363,090, filed on Mar. 12, 2002, provisional application No. 60/383,616, filed on May 29, 2002.

(30) Foreign Application Priority Data

Mar. 5, 2002 (FR) ..... 02 02767
Mar. 13, 2002 (FR) ..... 02 03140

(51) Int. Cl.
*A46B 9/00* (2006.01)
*A46B 9/02* (2006.01)
*A46B 3/18* (2006.01)

(52) U.S. Cl.
CPC ..... *A46B 9/028* (2013.01); *A46B 9/021* (2013.01); *A46B 2200/106* (2013.01); *A46B 2200/1053* (2013.01); *A46B 3/18* (2013.01)
USPC ..... 132/218

(58) Field of Classification Search
CPC ..... A46B 9/021; A46B 2200/1053; A46B 2200/106; A46B 3/18; A45D 40/265
USPC ..... 132/218, 219, 161, 141, 126, 120; 401/122–129; 15/206, DIG. 5
See application file for complete search history.

(56) References Cited

U.S. PATENT DOCUMENTS 1,921,328 A 8/1933 Shaw
1,958,134 A * 5/1934 Dike ..... 15/160

(Continued)

FOREIGN PATENT DOCUMENTS

CA 2314468 A1 * 1/2001
CN 1317943 A 10/2001

(Continued)

OTHER PUBLICATIONS

European Search Report for EP 10 17 8990, dated Apr. 7, 2011.

(Continued)

*Primary Examiner* — Robyn Doan
(74) *Attorney, Agent, or Firm* — Jones Robb, PLLC

(57) ABSTRACT

A device and method for combing eyelashes and/or eyebrows, and/or for applying makeup to eyelashes and/or eyebrows is disclosed. One exemplary device has a support and at least one row of projecting elements on the support. The row has a first group of the projecting elements and a projecting element outside the first group, the projecting element outside of the first group being spaced apart from the first group by a gap. The projecting elements can separate the eyelashes and/or eyebrows, while the gaps can group the eyelashes and/or eyebrows.

30 Claims, 12 Drawing Sheets

(56) References Cited

U.S. PATENT DOCUMENTS

| | | | | | |
|---|---|---|---|---|---|
| 2,497,209 | A | | 2/1950 | Davitcho | |
| 2,605,773 | A | | 8/1952 | Auclair | |
| 2,909,183 | A | | 10/1959 | Jordan | |
| 3,669,130 | A | * | 6/1972 | Petroczky | 132/138 |
| 3,908,576 | A | | 9/1975 | Van der Gaag | |
| 3,921,650 | A | | 11/1975 | Montgomery | |
| 4,411,282 | A | | 10/1983 | Wavering | |
| 4,527,575 | A | * | 7/1985 | Vasas | 132/218 |
| 4,565,205 | A | | 1/1986 | Taylor | |
| 4,586,520 | A | | 5/1986 | Brittain | |
| 4,662,385 | A | | 5/1987 | Schefer | |
| 5,007,442 | A | * | 4/1991 | Hirzel | 132/218 |
| 5,345,644 | A | | 9/1994 | Gueret | |
| 5,357,987 | A | * | 10/1994 | Schrepf | 132/218 |
| 5,542,439 | A | | 8/1996 | Gueret | |
| 5,595,198 | A | * | 1/1997 | Kemmerer | 132/218 |
| 5,709,230 | A | | 1/1998 | Miraglia | |
| 5,853,011 | A | | 12/1998 | Gueret | |
| 6,260,558 | B1 | * | 7/2001 | Neuner | 132/218 |
| 6,289,902 | B1 | | 9/2001 | Mathiez | |
| 6,345,626 | B1 | | 2/2002 | Bouix | |
| 2002/0011251 | A1 | | 1/2002 | Gueret | |

FOREIGN PATENT DOCUMENTS

| | | | | |
|---|---|---|---|---|
| EP | 0 792 603 | | | 9/1997 |
| EP | 1 155 637 | A1 | | 11/2001 |
| GB | 2170996 | A | * | 8/1986 |
| JP | S53-102783 | A | | 8/1978 |
| JP | S53-102783 | U | | 8/1978 |
| JP | S56-145809 | A | | 11/1981 |
| JP | S58-084012 | U | | 6/1983 |
| JP | 59-65614 | | | 5/1984 |
| JP | 60-70216 | | | 5/1985 |
| JP | S61-193604 | A | | 8/1986 |
| JP | S61-164614 | U | | 10/1986 |
| JP | 3-36525 | | | 5/1991 |
| JP | 5-508091 | | | 11/1993 |
| JP | 5-88410 | | | 12/1993 |
| JP | HO6-022815 | A | | 2/1994 |
| JP | H06-041601 | U | | 6/1994 |
| JP | HO8-033518 | A | | 2/1996 |
| JP | H10-215943 | A | | 8/1998 |
| JP | 2001-286340 | | | 10/2001 |
| WO | WO 92/11785 | | | 6/1992 |
| WO | WO 01/05274 | A1 | | 1/2001 |

OTHER PUBLICATIONS

Notification of Reasons for Rejection with partial English translation, Sep. 16, 2010.

Japanese Office Action dated Aug. 1, 2005 for Japanese Application 2003-058966.

* cited by examiner

DEVICE FOR COMBING AND/OR BRUSHING EYELASHES AND/OR EYEBROWS, AND/OR FOR APPLYING MAKEUP THERETO

This application is a division of application Ser. No. 10/377,629, filed Mar. 4, 2003 now U.S. Pat. No.7,789,094, which is incorporated herein by reference, and which claims the benefit of priority under 35 U.S.C. §119(e) of U.S. Provisional Application No. 60/363,090, filed Mar. 12, 2002, and U.S. Provisional Application No. 60/383,616, filed May 29, 2002.

The present invention relates to a device for combing keratinous fibers, such as eyelashes and/or eyebrows, and/or for applying a cosmetic, such as mascara, thereto.

The present invention also relates to a brush for applying makeup, such as mascara, to the eyelashes and/or the eyebrows.

BACKGROUND OF THE INVENTION

Various applicators have been proposed previously. Examples of applicators are disclosed in the following published European patent applications: EP 1 070 465, EP 1 070 466, EP 1 070 467, EP 1 070 468, EP 1 115 303, EP 1 115 304, EP 1 115 305, EP 1 157 629, EP 1 157 632, and EP 1 169 941, and also in the following published French patent application: FR 2 810 861. Another example of a brush is set forth in published patent application GB-A-2 170 996, which discloses a brush having a notch extending along a helical path around its axis, and a brush having a succession of notches extending all around the brush, wherein the brushes disclosed in that reference are designed to apply mascara uniformly to the eyelashes and separate each of the eyelashes from one another, without the eyelashes sticking together.

There is a need for a device that might be capable of certain makeup effects to be implemented on the eyelashes and/or eyebrows, regardless of whether they are already coated in makeup.

SUMMARY

In the following description, certain aspects and embodiments will become evident. It should be understood that the invention, in its broadest sense, could be practiced without having one or more features of these aspects and embodiments. It also should be understood that these aspects and embodiments are merely exemplary.

In one aspect, as embodied and broadly described herein, the invention may include a device for combing eyelashes and/or eyebrows, and/or for applying makeup to eyelashes and/or eyebrows, wherein the device may comprise a support lacking a core defined by two twisted-together branches; and at least one row of projecting elements extending along an axis. The row may include at least a first group of the projecting elements, wherein the first group may comprise at least three consecutive projecting elements spaced from one another such that projecting elements of each consecutive pair of the at least three consecutive projecting elements are spaced from one another by a substantially constant mutual spacing. The row also may include a fourth projecting element outside the first group, wherein the fourth projecting element is spaced apart from the first group by a gap (e.g., a gap having no projecting element identical to any one of the three projecting elements of the first group) extending along the axis of the row over a distance greater than said substantially constant mutual spacing.

In some embodiments, the projecting elements may be connected to the support via base portions having an arbitrary shape and orientation.

In another aspect, there is a device including a support defining a longitudinal axis, wherein the support tacks a core defined by two twisted-together branches. The device also may include at least one row of projecting elements substantially aligned in a direction substantially parallel to the longitudinal axis of the support (e.g., substantially aligned along the longitudinal axis itself and/or substantially aligned with an imaginary line substantially parallel to that axis). The at least one row may comprise at least a first group of the projecting elements, wherein the first group comprises at least two projecting elements adjacent to each other and spaced from one another by a spacing, and wherein the first group has a length measured parallel to said longitudinal axis (e.g., measured along the longitudinal axis and/or along an imaginary line parallel to that axis). The at least one row also may comprise a third projecting element outside the first group, wherein the third projecting element is spaced apart from the first group by a gap extending over a distance measured parallel to said longitudinal axis, and wherein said distance is greater than said spacing between the two adjacent projecting elements of the first group and shorter than said length of the first group.

In still another aspect, there is a device including an elongate support defining a longitudinal axis and comprising a face situated on one side of the support. The device further may include at least one row of projecting elements extending from the face, wherein at least one of the projecting elements has a base portion extending from the support, said base portion having a longitudinal axis that is not oblique relative to the longitudinal axis of the support. The row may comprise at least a first group of the projecting elements, wherein the first group comprises at least two projecting elements adjacent to each other and spaced from one another by a spacing. The row also may comprise a third projecting element outside the first group, wherein the third projecting element is spaced apart from the first group by a gap (e.g., a gap having no projecting element identical to either of the at least two projecting elements of the first group) extending over a distance measured in a direction parallel to said longitudinal axis, and wherein said distance is greater than said spacing between the two adjacent projecting elements of the first group.

In a further aspect, there is a device including a support comprising at least one face and at least one row of projecting elements extending from the at least one face of the support, wherein the projecting elements define gaps configured to permit a plurality of eyelashes and/or eyebrows to pass through the gaps so as to coat the eyelashes and/or eyebrows in makeup and form bunches of eyelashes and/or eyebrows that are not separated.

In some embodiments, the spacing between the projecting elements of a group (e.g., the first group), when the group has more than three elements, may be constant. By way of example, the support may present a single face having all of the projecting elements connected thereto, or in another example, it may present two substantially opposite faces to which all of the projecting elements are connected, e.g., in alternation.

The spacing between two projecting elements may be measured at their tips when each of the projecting elements in question has a single tip end. When each projecting element presents a plurality of ends at its upper portion, as applies for example when each of the projecting elements has at least two top branches which are constituted by respective tufts of bristles inserted in a hole in the support, then the spacing between the projecting elements may be measured at their bases or between the axes of their holes.

Some embodiments of the invention may make it quite easy to obtain makeup effects that are relatively difficult to achieve with known applicators, in particular makeup in which some of the eyelashes and/or eyebrow hairs are grouped together in groups (e.g., bunches).

In some embodiments, each projecting element may be elongate along a respective longitudinal axis and may have a base portion having a non-oblong cross-section in a plane perpendicular to its longitudinal axis. Such a projecting element may extend non-obliquely relative to the longitudinal axis of the support.

For some embodiments, each projecting element may be elongate along a longitudinal axis and have a base portion having an oblong cross-section in a plane perpendicular to its longitudinal axis, the oblong cross-section being angularly positioned in either a direction forming a substantially zero angle or a direction substantially perpendicular to the axis of the row.

In another aspect, the axis of the row may be substantially parallel to an axis defined by the support to which the projecting elements are connected.

According to another aspect, the device may comprise a second group of projecting elements. Such a second group may include projecting elements outside of the first group (e.g., possibly the third projection element and/or the fourth projection element). Such a second group may also include adjacent projecting elements (e.g., possibly two or more adjacent projecting elements) and/or consecutive projecting elements (e.g., possibly three or more consecutive projecting elements).

In still another aspect, the projecting element outside the first group (e.g., possibly the third projection element or the fourth projection element) may be separated from an adjacent projecting element of the second group by a spacing that is smaller than the distance of the gap. For example, this spacing may be substantially equal to the spacing between the projecting elements of the first group According to still another aspect, the first group of projecting elements may extend over a distance that is greater than the distance of the gap. Such a first group of projecting elements may extend along the axis of the row.

In yet another aspect, the axis (e.g., the longitudinal axis of the support or the axis of the row) may be rectilinear or non-rectilinear.

According to yet another aspect,the row may extend along an axis that is rectilinear or non-rectilinear.

In a further aspect, at least two projecting elements of the first group and the projecting element outside of the first group (e.g., possibly the third projection element and/or the fourth projection element) may occupy respective positions along the axis of the row which are substantially multiples of a given pitch. For example, the distance separating the projecting element outside the first group from the first group of projecting elements may be substantially two or three times the pitch.

In an additional aspect, a plurality of groups of projecting elements may be regularly spaced apart. For example, the distance from any one group of projecting elements to an adjacent group of projecting elements may be constant.

According to still another aspect, all of the projecting elements may be identical in shape.

In still a further aspect, the device may comprise at least two projecting elements having shapes differing from one another.

In yet another aspect, the projecting elements may be teeth (e.g., possibly two or more projecting elements may be teeth). Such projecting elements (e.g., teeth) may have a substantially triangular profile shape when the row of projecting elements is viewed along a direction that is substantially perpendicular to the axis of the row. Such projecting elements (e.g., teeth) may have differing slopes.

According to yet another aspect, the teeth may have a substantially triangular profile shape when the row is viewed along a direction substantially perpendicular to an axis of the row of teeth. Some of such teeth may have differing heights and/or base portions having differing widths.

In another aspect, the device may include at least one relief portion between the first group and the projecting element outside of the first group (e.g., possibly the third projection element and/or the fourth projection element). Such a portion in relief may make it easier, for example, to retain makeup in the gap situated between the first group of projecting elements and the projecting element outside of the first group.

In a further aspect, at least two of the projecting elements of the first group of projecting elements together may define a substantially V-shaped groove when the group is viewed from the side, or when the group is viewed in a direction substantially perpendicular to the axis. The bottom of such a groove may be situated, for example, at a non-zero distance from the support to which the projecting elements defining the groove are connected.

In still another aspect, the device may include at least two rows of projecting elements. Each of these rows may comprise several successive projecting elements (e.g., possibly three successive projecting elements) placed at substantially constant spacing from one another, and an additional projecting element (e.g. possibly a fourth projecting element) separated from the nearest projecting element of the several successive projecting elements by a distance that is greater than the spacing between the several successive projecting elements. The rows of projecting elements may be substantially parallel. Such rows of projecting elements may be configured so that the projecting elements of one row and those of another row extend in differing directions.

In an additional aspect, at least one of the projecting elements may have a side surface having portions in relief and/or an angular portion. At least one of the projecting elements may also carry flocking. According to another aspect, at least one of the projecting elements of a group of projecting elements may be of a size that is substantially different from the size of the other elements in the group. For example, the height of the projecting elements may be in a range of from 0.5 millimeters (mm) to 10 mm, or, alternatively in a range from 1 mm to 3 mm.

According to still another aspect, a row of projecting elements may comprise at least one succession of projecting elements extending, at least in part, alternately on opposite sides of a geometrical separation surface.

In still a further aspect, the projecting elements of a row may have bases that are substantially in alignment with one another. For example, the base portions of the projecting elements of a row may be aligned in a direction substantially parallel to a longitudinal axis of the support. In another example, a portion of each of the bases of consecutive projecting elements may be disposed on a first side of a line passing through the bases of the consecutive projecting elements, and another portion of each of the bases of the consecutive projecting elements may be disposed on an opposite, second side of the line, the line being substantially parallel to a longitudinal axis of the support on which the projecting elements may be disposed. In another example, the projecting elements with bases that are substantially in alignment may be comprised of consecutive projecting elements that are disposed in such a manner that a straight line passes through the centers of the respective bases of the consecutive projecting elements. For instance, the centers of the bases of three consecutive projecting elements may lie on the same straight line.

In yet another aspect, the support may comprise a plurality of support portions that are movable relative to each other and have projecting elements extending therefrom. The support portions may be movable relative to each other so as to enable a user to modify the spacing between projecting elements. These movable support portions may be separated by a geometrical separation surface and may be movable relative to each other in a direction parallel to the axis of the support.

According to yet another aspect, a row of projecting elements may comprise projecting elements placed on a first side of a wall. Such a wall may have a second side opposite from the first side, and the second side may be connected over at least a fraction of its length to a support.

In another aspect, the device may comprise a first portion and a second portion connected together via a device base. A plurality of projecting elements may be disposed on a support, the support being connected to the device base portion over no more than a fraction of its length.

In a further aspect, the support may define at least one opening situated between two opposing regions of the support. A row of projecting elements may extend from at least one of the opposing regions towards the other region. The support for the projecting elements may be perforated and define at least one opening situated between the two opposing regions of the support. At least one row of projecting elements may be connected to at least one of the opposing regions and extend towards the other region. For example, the support may be closed around an opening. Such an opening may be planar or have any other shape.

In still another aspect, the projecting elements (e.g. the projecting elements in a row) may comprise tufts of bristles. Such tufts may be fitted to a support, the support possibly being different from a core constituted by two twisted-together branches of a wire. The support may have at least one hole into which a tuft of bristles may be fixed.

In an additional aspect, at least one of the projecting elements may comprise a plastic material. For example, all of the projecting elements in at least one row of projecting elements may be part of an integral, single piece of molded plastic. In another example, the integral, single piece of molded plastic may include all or part of the support as well. The plastic material may contain a filler (e.g., a material for improving the sliding properties of the projecting elements over keratinous fibers). For example, the material may be selected from the following list: polytetrafluoroethylene; graphite; silicones; molybdenum disulfide; and other derivatives thereof. The filler may also comprise magnetic particles and/or a biocidal agent (e.g., a metal salt).

According to another aspect, the device may comprise a rod having a first end portion and a second end portion. A support may be at the first end portion, while a handle element may be at the second end portion. Such a support may be connected to at least one row of projecting elements. Such a support may be made by being molded integrally with the rod out of an elastomer material or of some other material, or it may be fitted to the rod. For example, the support and rod may be a part of an integral, single piece of molded material. Additionally, the support may be comprised of an elastomer material.

According to still another aspect, the device may include a supply of makeup to be applied to the eyelashes and/or the eyebrows. This supply of makeup may be contained, for example, in a receptacle. The supply of makeup may be in the form of a flowable substance (e.g., liquid) or a cake of solid makeup (e.g. suitable for dispersing on coming into contact with a liquid). The device may also be configured to permit at least the support and the projecting elements to be passed into the receptacle. The device may further include a handle element associated with the support. Such a handle element may comprise a closure for the receptacle.

In still a further aspect, the device may include a wiper member which may be associated with a receptable. Such a wiper member may define a passage, and may have projecting members that are configured so as not to bend significantly when passing through the passage. For example, the wiper member may be comprised of an elastomer lip, and the projecting elements may be comprised of a plastic material that may be more rigid than the plastic material from which the lip may be made.

In yet another aspect, the device may include a wiper member that may be configured to leave a blob of makeup, for example, in the above-mentioned gap. In another example, the wiper member may be configured so as to avoid significantly engaging the gap. For example, such a wiper member may be substantially prevented from engaging the gap by the projecting elements. In another example, the support to which the projecting elements are connected may have end portions configured to assist in passing through the wiper member.

According to yet another aspect, a row of projecting elements may have six to fifteen projecting element.

In another aspect, the spacing between two adjacent projecting elements may be greater than or equal to 2.5 mm.

In still another aspect, at least some of the projecting elements may have free ends facing in different directions.

An additional aspect relates to a method of making up eyelashes and/or eyebrows which may comprise providing a device as described herein, applying makeup to the eyelashes and/or the eyebrows, and combing the eyelashes and/or the eyebrows using the device, so as to form groups of non-separated eyelashes and/or eyebrow. (As used herein, the term "eyebrows" refers to hairs present on the ridge(s) over an individual's eye(s). Accordingly, a single "eyebrow," as that term is used herein, is a single hair.)

According to another aspect, makeup may be applied using the device.

According to still another aspect, makeup may be applied using an applicator differing from the device.

In still a further aspect, the makeup may comprise mascara.

In yet another aspect, the makeup may be applied to the eyelashes and the eyelashes may be combed.

According to yet another aspect, a method of making up the eyelashes and/or the eyebrows comprises providing a device as described herein, loading the projecting elements of the device with makeup, the makeup being present in the gap, and applying the makeup to the eyelashes and/or the eyebrows using the device (e.g., bringing the makeup laden gap into contact with the eyelashes and/or eyebrows) so as to form a set of at least two non-separated eyelashes and/or eyebrow hairs.

In another aspect, groups of non-separated eyelashes and eyebrows may be formed.

In still another aspect, the makeup may be applied to the eyelashes.

In another aspect, the makeup present in the gap may be deposited on the eyelashes and/or eyebrows that are to be united by engaging the eyelashes and/or eyebrows in the gap.

In an additional aspect, there is a device for combing the eyelashes and/or eyebrows, and/or for applying makeup. The device may comprise at least a first group of projecting elements configured to be capable of separating eyelashes and/or eyebrows, and at least one projecting element outside of the group. The first group of projecting elements and the at least one projecting element outside the first group may allow eyelashes and/or eyebrows to pass between them without being separated.

According to another aspect, there is a device for applying makeup to eyelashes and/or eyebrows. Such a device may comprise a support having at least one face, and at least one row of projecting elements extending from the at least one face of the support. In such a device, the projecting elements may define gaps configured to permit a plurality of eyelashes and/or eyebrows to pass through the gaps so as to coat the eyelashes and/or eyebrows in makeup and form bunches of eyelashes and/or eyebrows that are not separated.

According to yet another aspect, there may be a succession of groups each having at least two projecting elements. Such projecting elements may be aligned in a direction parallel to a longitudinal axis of support, the spacing between consecutive groups (e.g., possibly two consecutive groups) being greater than the spacing between adjacent projecting elements within a group.

In another aspect, there may be a succession of groups each having at least two projecting elements. Each of such projecting elements may be oriented toward at least one other projecting element of the group.

In a further aspect, the device may include makeup to be applied to the eyelashes and/or the eyebrows.

In still another aspect, the device may include a receptacle containing makeup.

In an additional aspect, the device may be configured so as to permit at least the support and the projecting elements to pass into the receptacle.

According to another aspect, the device may include a handle element associated with the support, wherein the handle element could comprise a closure for the receptacle.

In a further aspect, a method of making up the eyelashes and/or the eyebrows may comprise providing a comb for applying makeup to the eyelashes and/or the eyebrows. The comb may include at least one row of teeth extending along a row axis. The teeth may present a profile that is substantially triangular when the comb is observed in a direction substantially perpendicular to the row axis. The row may also comprise at least two teeth situated at a distance from the ends of the comb and possibly having differing shapes. For example, the teeth may have differing slopes and/or heights. The teeth of the row may be disposed such that they are not separated by a constant spacing, the spacing possibly being measured at their tips or at their bases. Between its teeth, such a comb may present interstices of different shapes, enabling novel makeup effects to be obtained.

In still another aspect, there is a device for applying makeup to the eyelashes and/or the eyebrows. The device may comprise at least one row of projecting elements, for example teeth, connected to at least one face of a support, the face possibly being situated on one side of the support, wherein the projecting elements may be configured to form gaps enabling a plurality of eyelashes to pass between them so as to coat the eyelashes with makeup and form groups (e.g., bunches) of non-separated eyelashes.

In an additional aspect, the device may include at least one succession of projecting elements that may be widely spaced apart. In addition, the number of elements may lie, for example, in the range of six to 15 (e.g., close to ten). The spacing between two projecting elements may be greater than or equal to 2.5 mm (e.g., close to 3 mm).

According to another embodiment, the device may include a succession of groups. Each group may be formed of at least two teeth, and the teeth may be in alignment with a longitudinal axis of support. The spacing between at least two consecutive groups may be greater than the spacing between the projecting elements within a group. As the teeth may be in alignment along the longitudinal axis of the support, a straight line intersecting at least two projecting elements of a group may be parallel to the longitudinal axis.

According to still another embodiment, the device may include a succession of groups of at least two projecting elements. Each projecting element within a group may be oriented towards the other projecting element of the group. For example, the ends of the projecting elements may be sufficiently close together to prevent an eyelash from passing easily between them.

In still a further aspect, a face of the support to which the projecting elements may be connected may be substantially planar, or concave or convex, when the device is observed perpendicularly to the longitudinal axis of the support.

In another aspect, there is a brush for applying makeup to eyelashes and/or eyebrows. The brush may comprise a core, bristles comprising end portions extending radially around at least a portion of the core, the bristles defining a bristled portion of the brush having a first length, and at least one notch having a second length less than half the first length. The brush may have a non-circular cross-section in a plane perpendicular to the core and intersecting the notch. The at least one notch may be configured to form at least one bunch of eyelashes and/or eyebrows that are not separated from one another when the brush is used to apply makeup thereto.

In a further aspect, the brush may comprise a plurality of notches along the length of the brush. At least some of plurality of notches may face in substantially the same direction.

In still a further aspect, there is a system that may comprise a brush as described herein and makeup to be applied to the eyelashes and/or eyebrows. The system may be configured to permit the brush to be passed into the receptacle. Additionally, the system may comprise a handle element that may be associated with the brush. The handle element may also comprise a closure for the receptacle. The system may also comprise a wiper member that may be associated with the receptacle.

In still another aspect, there is a brush for applying makeup to the eyelashes and/or the eyebrows that may comprise a core, bristles comprising portions extending substantially radially from the core around at least a portion of the core, the bristles defining a bristled portion of the brush, and at least one notch in the bristled portion of the brush, the notch comprising at least one bristled region having bristles of a height that is substantially zero. As used herein, the term bristles having a height that is "substantially zero" refers to bristles having very short end portions that do not normally contact and separe eyelashes and/or eyebrows when the brush is used to comb the lashes and/or apply makeup thereto.

In still a further aspect, a method of making up eyelashes and/or eyebrows may comprise providing a brush as described herein, applying makeup to eyelashes and/or eyebrows, and combing the eyelashes and/or the eyebrows using the brush, so as to form groups of non-separated eyelashes and/or eyebrows. Additionally, makeup may be applied using the brush. Furthermore, the makeup may comprise mascara. In addition, the makeup may be applied to the eyelashes, and the eyelashes may also be combed.

In another aspect, a method of making up eyelashes and/or eyebrows may comprise providing a brush as described herein, loading the brush with makeup (the makeup possibly being present in the notch), and applying the makeup to eyelashes and/or eyebrows using the brush, so as to form at least one group of at least two non-separated eyelashes and/or eyebrows. Additionally, groups (e.g. bunches) of non-separated eyelashes and/or eyebrows may be formed. Furthermore, the makeup may comprise mascara. In addition, the makeup may be applied to the eyelashes, and the eyelashes may also be combed.

In an additional aspect, a method of making up eyelashes and/or eyebrows may comprise loading a brush with makeup. The brush may have bristles defining a bristled portion of the brush having a first length, the brush also possibly having at least one notch in which the makeup accumulates, the notch possibly having a second length less than half the first length. The method may additionally comprise applying the makeup contained in the notch to eyelashes and/or eyebrows in such a manner so as to form at least one group of non-separated eyelashes and/or eyebrows.

In an additional aspect, the portion of the brush having bristles of substantially zero length may extend along the brush over a length that is shorter than the length of the portion of the brush carrying bristles.

According to another aspect, the notch may not extend all the way around the core of the brush.

According to still another aspect, the brush may be loaded in a non-uniform manner with makeup and may enable novel makeup effects to be obtained.

In still a further aspect, the brush may be used in association with a receptacle containing makeup for application to the eyelashes and/or the eyebrows. The receptacle may be provided with a wiper member for wiping the brush as it leaves the receptacle, the wiper member possibly being configured to leave makeup in the notch.

In yet another aspect, the wiper member may have an inner outline that intersects the notch, the intersection possibly occurring in a plane that extends transversely with respect to the brush.

According to yet another aspect, the brush may be incompletely wiped in the notch and the makeup present in the notch after the brush has been extracted from the receptacle may be used for forming bunches of eyelashes or eyebrows .

In another aspect, if the notch extends over only a portion of the length of the brush, the bristles may carry relatively little makeup. Such bristles may be suitable for use to separate eyelashes or eyebrows.

In some embodiments, the wiper member may define a wiper orifice of a circular outline. The orifice may have a radius greater than a length measured from the core of at least a portion of the bristles which may define the bottom of the notch.

In still other embodiments, the notch may have a portion with a cross-section that is constant in shape while moving along the length of the brush. The entire notch may have a cross-section that is constant while moving along the length of the brush.

In an additional aspect, the notch may be defined circumferentially by at least one substantially radial face (e.g., by two substantially radial faces).

According to another aspect, the notch may be defined axially by at least one face that slopes relative to a plane perpendicular to the core of the brush (e.g., by two faces that may diverge on going away from the core of the brush).

According to still another aspect, the notch may extend partially around the core (e.g., less than) 360°. For example, the notch may extend around the core for angles that range from 20° to 200°. In another example, the notch may extend around the core for one of the following angle ranges: 40° to 50°; 110° to 130°; 170° to 190°. In yet another example, the notch may extend over a circumferential dimension that is greater than its axial dimension.

In still a further aspect, the notch may extend along the brush over a length that may range from 1.5 mm to 6.5 mm (e.g., 2.5 mm). For example, the maximum depth of the notch may range from 2.5 mm to 4 mm.

In yet another aspect, the notch may extend over less than 4/10ths of the length of the portion of the brush carrying bristles. For example, the notch may extend over less than 3/10ths of the length.

According to yet another aspect, the brush may have at least two notches as described herein. For example, the brush may have notches (e.g., at least two notches) that are offset circumferentially. In another example, the brush may have notches that are on diametrically opposite sides. In yet another example, notches may be offset axially. In a further example, the brush may have notches that are offset both circumferentially and axially.

In another aspect, when the brush is observed in at least one plane perpendicular to the axis of the brush, the brush may have a plurality of notches (e.g., three).

In a further aspect, the brush may have bristles of a length that ranges from 3.5 mm to 9 mm. For example, the diameter of the bristles may range from 0.06 mm to 0.4 mm.

In still another aspect, over at least a fraction of its length, the brush may define an envelope surface of circular right section (e.g., a surface that is cylindrical or conical).

In an additional aspect, the brush may define, over at least a fraction of its length, an envelope surface that has a polygonal right section. For example, the brush may define a prismatic surface in the form of a regular polygon (e.g., that is substantially triangular or substantially in the shape of a square).

According to another aspect, the brush may have a majority of zones that are suitable for separating eyelashes.

According to still another aspect, the volume defined by the notches may be less than the volume defined by the envelope of the brush outside the notches (e.g., by a factor of at least two).

In still a further aspect, the brush may be connected to a first end of a rod having a second end connected to a handle member. The handle member may be suitable for fixing onto a receptacle (e.g., in a leaktight manner).

In yet another aspect, the brush may have a core constituted by two or more twisted-together branches of wire. For example, the branches may be portions of the same wire (e.g., the wire may be folded in half to define the bristles) or initially separate wire segments.

According to yet another aspect, the core may be formed by winding the individual cores of two individual brushes one around the other, the individual cores being twisted relative to each other. Each individual core may be made in a conventional manner from two twisted-together branches of wire.

In another aspect, the brush may have a plurality of notches and at least one twisted core. The distance measured axially between the notches may be decorrelated relative to the pitch at which the core is twisted.

In a further embodiment, the brush may have notches configured such that in one view, the brush may appear to have no notches when the brush is viewed in a first orientation relative to the direction of observation. When the brush is viewed in a second orientation relative to the same direction of observation, the brush may appear to have notches disposed substantially in alternation on the top and bottom edges of the brush. The second orientation may be obtained by turning the brush about the axis of the rod through one-fourth of a turn away from the first orientation.

In still another aspect, the core of the brush is not rectilinear. Such a core may be inclined relative to the axis of the rod by an angle that increases on approaching the free end of the brush. For example, such an inclination may make the brush more ergonomic.

In an additional aspect, the notch may extend all around the core of the brush.

According to another aspect, the notch or notches may be made by clipping bristles.

According to still another aspect, the notch or notches may be made by melting bristles.

In still a further aspect, the brush may be made so as to avoid presenting any perceptible spiral effect. The term "spiral effect" may be defined to mean the tendency of the bristles to extend in substantially helical sheets. To diminish the spiral effect, the bristles may be selected so as to become tangled with one another when the branches of the core are twisted together. For example, the bristles may be of relatively small diameter (e.g., less than or equal to $^{15}/_{100}$ mm). In another example, the bristles may be hollow. In yet another example, the bristles may be made of a soft material. In a further example, the bristles may present a cross-section that is not circular (e.g., a cross-section presenting one or more longitudinal grooves).

In yet another aspect, there is a method of making a brush which may comprise providing (e.g., making) an initial brush having bristles formed of a material capable of melting when heated, and forming at least one notch in the brush by melting bristles present in the portion that is to form the notch.

According to yet another aspect, there is a method of applying makeup to the eyelashes and/or the eyebrows which may comprise providing a brush as described herein, loading the brush with the makeup to be applied, the brush presenting at least one notch in which the makeup may accumulate, the notch extending over less than half of the length of the portion of the brush carrying bristles, and applying the makeup contained in the notch to the eyelashes and/or the eyebrows in such a manner as to form at least one group (e.g., bunch) of non-separated eyelashes and/or eyebrows.

In another aspect, the brush may be loaded with makeup taken from a receptacle that is provided with a wiper member configured to leave makeup in the notch.

In a further aspect, the makeup may be applied to the eyelashes or the eyebrows so as to form groups (e.g., bunches) of eyelashes or eyebrow hairs. Additionally, the makeup may be applied so as not only to form bunches of eyelashes or eyebrow hairs, but also to leave, for example, well-separated eyelashes or eyebrow hairs between said bunches.

In still another aspect, there is a device that may comprise a receptacle containing makeup to be applied to the eyelashes and/or the eyebrows, a brush comprising a core and bristles having end portion extending around the core, the brush having at least one notch, the brush presenting a cross-section of arbitrary shape in a plane intersecting the notch, and a wiper member for wiping the brush as it leaves the receptacle, the wiper member being configured to leave makeup in the notch. The wiper member may also have an inner outline that intersects the notch, for example in a plane extending transversely to the brush.

The term "providing" is used herein in a broad sense, and refers to, but is not limited to, making available for use, enabling usage, giving, supplying, obtaining, getting a hold of, acquiring, purchasing, manufacturing, selling, distributing, possessing, making ready for use, and/or placing in a position ready for use.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate exemplary embodiments of the invention and, together with the description, serve to explain some principles of the invention. In the drawings.

MORE DETAILED DESCRIPTION

Figure 1:
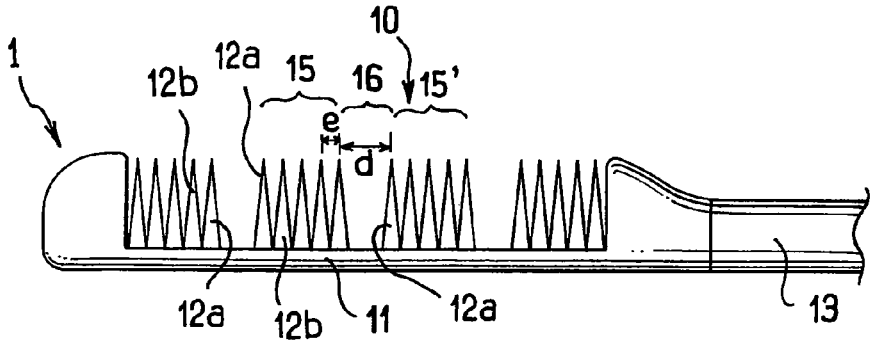
FIG. 1 is a partial schematic side view of an embodiment of a device for combing eyelashes and/or eyebrows, and/or for applying makeup to eyelashes and/or eyebrows.

Reference will now be made in detail to some possible embodiments of the invention, examples of which are illustrated in the accompanying drawings. Wherever possible, the same reference numbers are used in the drawings and the description to refer to the same or like parts.

FIG. 1 depicts an exemplary embodiment of a device 1. The device may comprise a comb 10 having a support 11 with projecting elements 12*a*, 12*b* connected thereto. The projecting elements may be identical or at least some of the elements may differ from other elements.

The comb 10 may be connected to a rod 13 (shown in part) which in turn may be connected to a handle member (not shown). The handle member may also have a closure cap as described herein.

The comb 10 may be used for combing the eyelashes and/or eyebrows after a cosmetic has been applied thereto, e.g., mascara, by means of another applicator, e.g., a brush. In one exemplary embodiment, the comb 10 may be used for applying the makeup to the eyelashes and/or eyebrows, with the comb initially being loaded with makeup (e.g., by being immersed in a receptacle containing the makeup).

In the exemplary example depicted in FIG. 1, the projecting elements 12*a* and 12*b* are shown as teeth. In one example, the teeth may be generally triangular in shape when the comb is observed from the side. However, the projecting elements may have another shape, or may be constituted by tufts of bristles fitted to the support, as described below.

The projecting elements 12*a* and 12*b* may be disposed on the comb in various ways. For example, at least one row of projecting elements may extend along a line substantially parallel to the axis of the support.

As depicted in the exemplary embodiment of FIG. 1, a row may comprise successive projecting elements (e.g., at least three successive projecting elements) disposed at a first spacing e from one another. In this exemplary embodiment, the first spacing e may be substantially constant. The projecting elements may belong to or form a group 15. In the exemplary embodiment shown, the row also may comprise a projecting element 12*a* (e.g., a fourth projecting element) outside of the group. In the exemplary embodiment depicted in FIG. 1, the reference term 12*a* is used to designate a projecting elements at the end of a group (or a projecting element that is isolated), while the reference term 12*b* is used to designate the projecting element(s) situated in-between the end projecting elements 12*a* of the group of projecting elements. The projecting element outside of the group may belong to a second group 15' of projecting elements and it may be spaced apart from the nearest of the projecting elements of the group 15 by a second spacing d that is greater than the first spacing e.

The group 15 may have projecting elements 12*a*, 12*b* that are relatively close together and the projecting elements may be configured so as to be suitable for separating eyelashes and/or eyebrows. Eyelashes and/or eyebrows also may pass between the groups 15 and 15', however, without being separated.

FIGS. 2 to 6 depict several examples of how the projecting elements may be spaced relative to each other.

In the exemplary embodiments depicted in FIGS. 2 to 6, the crosses represent the positions of projecting elements (e.g., the positions of their tips or of their base portions). The projecting elements in this exemplary embodiment are disposed in a row along a line X, which may be straight, in order to simplify explanation. However, the line X need not be straight or even be in a single plane. For example, the line X may be angled or curved.

Figure 2:
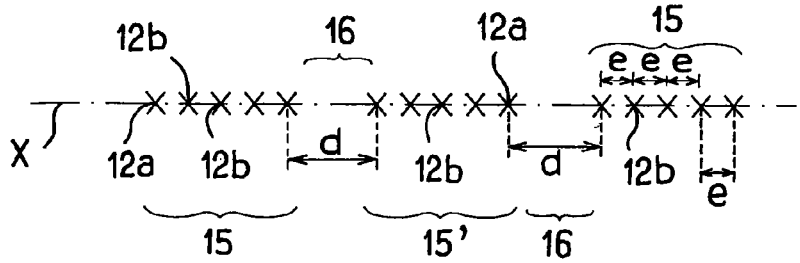
FIG. 2 is a diagrammatic view of the device of FIG. 1 showing an exemplary way in which projecting elements may be disposed on the device.

As depicted in the exemplary embodiment of FIG. 2, the projecting elements may form at least two groups 15, 15' along the support 11. Each group may be made up of projecting elements that are close enough together to be capable of separating eyelashes and/or eyebrows. The groups 15 and 15' may also be separated from each other by a gap 16 that has no projecting elements. In such an embodiment, the eyelashes and/or eyebrows may engage the projecting elements without being separated. The gaps 16 that may be disposed in-between the groups of projecting elements may enable the device to bunch together some eyelashes and/or eyebrows while simultaneously separating others so as to obtain a desired makeup effect.

Various embodiments may contain various combinations of shapes, numbers, and dispositions of projecting elements that still enable the desired makeup effect to be obtained.

As shown in the exemplary embodiment of FIGS. 1 and 2, the projecting elements may be disposed within group 15 or 15' and may be separated from other projecting elements in the same group by a spacing e that may be substantially constant. For example, all of the projecting elements 12*a* and 12*b* within a group 15 or 15' may be disposed along the line X. The axial positions of each of the individual projecting elements may be measured from a common origin. The common origin may be substantially the same as the position of the projecting element 12*a* situated at one end of the row. Accordingly, in one example, the projecting elements in a group may be separated from the common origin by a distance that is an integer multiple of the spacing e. Adjacent groups may be spaced apart from one another by the spacing d. As depicted in the exemplary embodiment of FIG. 2, the spacing d between groups may be a multiple of the spacing e (e.g., d=2e).

Figure 3:
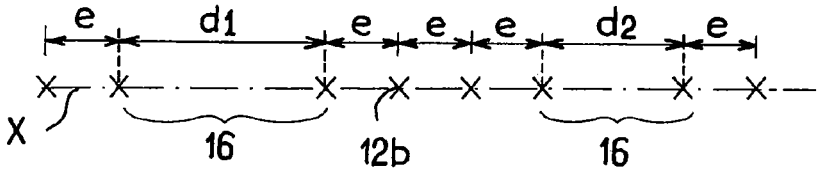
FIG. 3 is a diagrammatic view similar to that of FIG. 2 showing an alternative projecting element arrangement.

The distance between adjacent projecting elements 12*a* belonging to respective adjacent groups do not need to be constant. An example of such an exemplary embodiment is depicted in FIG. 3. In this exemplary embodiment, the gaps 16 have respective widths $d_1$ and $d_2$ that are different from each other and and are greater than the spacing e. However, widths $d_1$ and $d_2$ may also be substantially similar to each other.

Figure 4:
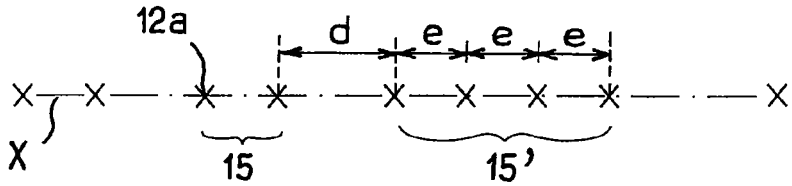
FIG. 4 is a diagrammatic view similar to that of FIG. 2 showing an alternative projecting element arrangement.

The groups may also have varying numbers of projecting elements, such as shown in the of FIG. 4.

Figure 5:
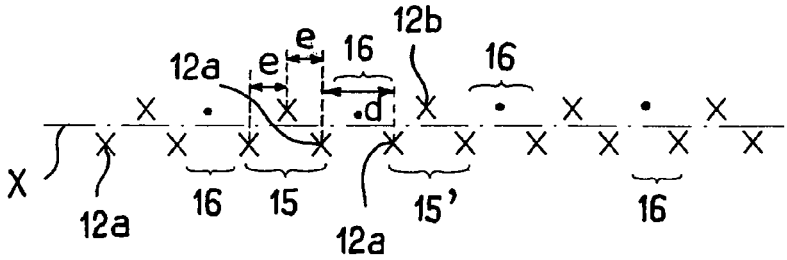
FIG. 5 is a diagrammatic view similar to that of FIG. 2 showing an alternative projecting element arrangement.

Within any one group, or in all of the groups, the projecting elements may have their tips or their bases aligned. As shown in FIGS. 2 to 4, however, it is also possible to have at least some of the projecting elements alternately offset on different sides (e.g., opposite) of a geometrical separation surface. Such a surface may contain, for example, the line along which at least some of the projecting elements are disposed. To illustrate one example of this embodiment, FIG. 5 depicts a row of successive projecting elements 12*a* and 12*b* alternately disposed in a regular manner on opposite sides of a geometrical separation surface. In addition, this exemplary embodiment shows that while all of the projecting elements situated on one side of the geometrical separation surface may be retained, projecting elements in row n may be omitted in regular manner on another side of the geometrical separation surface. For example, every other projecting element on one side of the geometrical separation surface may be omitted. To illustrate a possible depiction of this exemplary embodiment, in FIG. 5, the locations of the projecting elements that may be omitted are represented by dots. The distances e and d may be measured in a direction parallel to the line X.

Figure 6:
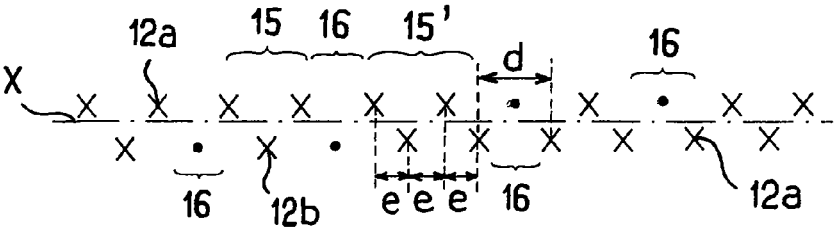
FIG. 6 is a diagrammatic view similar to that of FIG. 2 showing an alternative projecting element arrangement.

The gaps 16 may be created by a method other than by removing projecting elements from the same side of a geometrical separation surface. For example, FIG. 6 shows a disposition of projecting elements in which projecting elements have been removed from both sides of the geometrical separation surface. In a further example, an (integer) n number of projecting elements may be removed from one side of the geometric separation surface while a different (integer) m number of projecting elements may be removed from on the opposite side. In the alternative, m and n may be equal.

The comb in FIG. 1 may be used to apply makeup to the eyelashes and/or the eyebrows. Such a comb is not limited, however, to combing the eyelashes and/or eyebrows after makeup has been applied by means of a different applicator.

In another embodiment, the comb may be associated with a supply of makeup.

Figure 7:
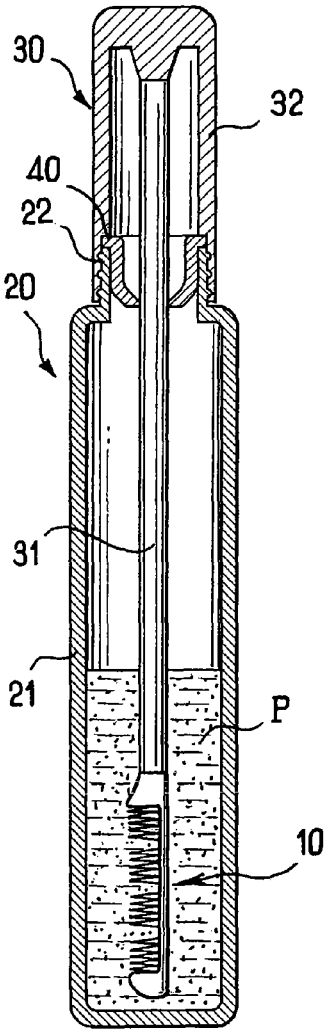
FIG. 7 is a schematic axial view of a system including the device of FIG. 1.

In another exemplary embodiment, FIG. 7 shows a device 20 comprising a receptacle 21 and an applicator 30. The receptacle 21 may contain makeup P for application to the eyelashes and/or eyebrows, and the applicator 30 may comprise a rod 31 provided at one end with an applicator element (e.g., possibly the comb 10 as described herein), and at its other end with a handle member 32. The handle member 32 may serve as a leaktight closure cap for the receptacle 21. For example, the handle member 32 may be screwed onto a neck 22 of the receptacle, the neck having an outside thread that engages the handle member.

In the example of FIG. 7, a wiper member 40 may be fixed inside the neck 22 to wipe the rod 31 and the applicator element 10 while the applicator is being withdrawn from the receptacle. This wiper member may enable makeup to be left in the gap 16 or gaps 16.

The projecting elements (e.g., the teeth of the comb 10), may be sufficiently rigid to avoid being laid flat during wiping. This rigidity may also contribute to building up supplies of makeup in the gaps 16, since the edge of the wiper lip may be configured so as to be incapable of reaching the bottoms of the gaps. It is also possible to obtain non-uniform distribution of makeup along the comb. For instance, the combing portions may be well wiped while the non-combing portions contain a quantity of makeup that is sufficient for bunching eyelashes together.

Additional embodiments of applicator elements that may be made in accordance with the invention are described below.

Figure 8:
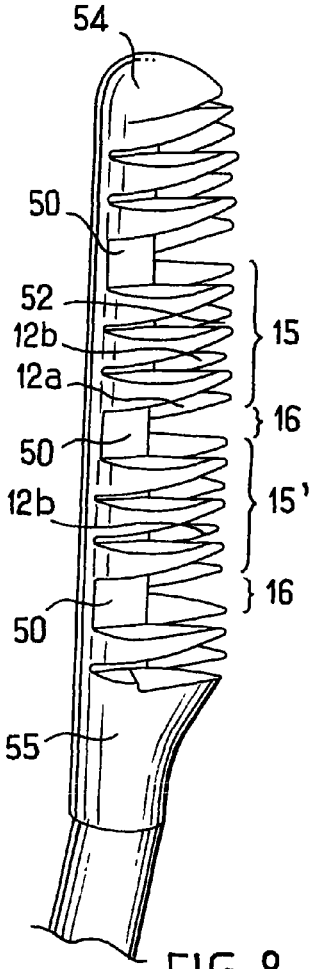

FIG. 8 depicts an example of a comb in which the teeth are placed in a configuration similar to that described above with reference to FIG. 5 (i.e., with a row of teeth extending along a support and the teeth in each group being disposed alternately on different sides of a geometrical separation surface). As compared to an example with a row of teeth in which all consecutive teeth may extend in alternation on opposite sides of a geometrical separation surface, in this example, certain teeth situated on a particular side of the surface have been removed, thereby leaving gaps 50.

FIG. 8 depicts an exemplary embodiments where the projecting elements 12*a*, 12*b* may be in the form of teeth. The teeth may have a width that tapers towards their free ends as measured parallel to the longitudinal axis of the applicator element. In such an embodiment, two adjacent projecting elements situated respectively on opposite sides of the geometrical separation surface may form a groove 52 having a substantially V-shaped profile when the comb is observed end-on. The bases of the teeth may extend obliquely or non-obliquely relative to the longitudinal axis of the support. As shown in the exemplary embodiment, the applicator element may have distal and proximal portions 54 and 55 that are shaped to facilitate passage through the wiper 40. Such distal and proximal portions do not constitute projecting elements, in accordance with the meaning of that term herein.

Figure 9:
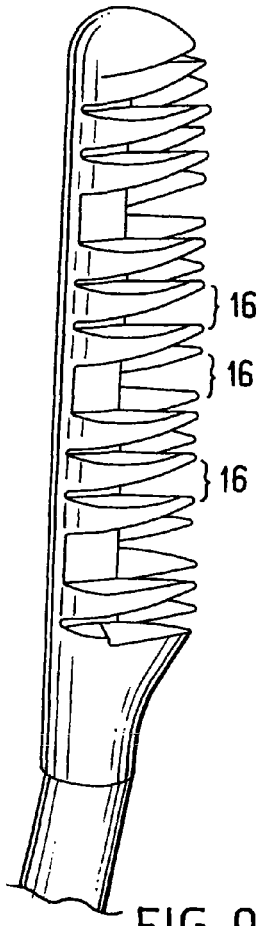
FIG. 8-19 are partial schematic views showing respective alternative embodiments of devices.

An applicator element shown in FIG. 9, may differ from that of the embodiment shown in FIG. 8 by the absence of a tooth within each of the groups 15 and 15'. Thus, additional groups of teeth and gaps 16 may be formed. Similar to the device of FIG. 6, the teeth that have been removed may be situated on differing sides of the geometrical separation surface.

Figure 10:
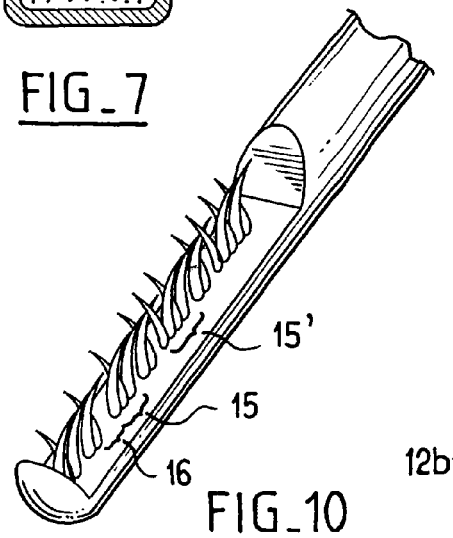

FIG. 10 depicts an applicator element that has a row of teeth whose base portions are in alignment. The free ends of the teeth may be disposed in a manner similar to the exemplary configuration shown in FIG. 6. For example, within each group of teeth, the ends of the teeth may be disposed in succession and substantially in alternation on either side of a geometrical separation surface.

Figure 11:
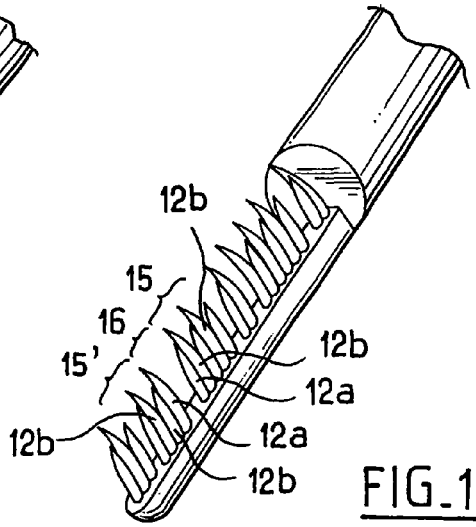

Another possible embodiment, as depicted in FIG. 11, may comprise a row of teeth whose base portions and free ends are situated substantially in the same plane. For example, the disposition of the base portions of the teeth may be similar to one of the configurations shown in FIGS. 3 and 4. FIG. 11 also shows that the projecting elements within a given group may have differing heights.

According to another exemplary embodiment, the projecting elements may present portions in relief or angular zones for more easily catching on the eyelashes and/or eyebrows.

Figure 12:
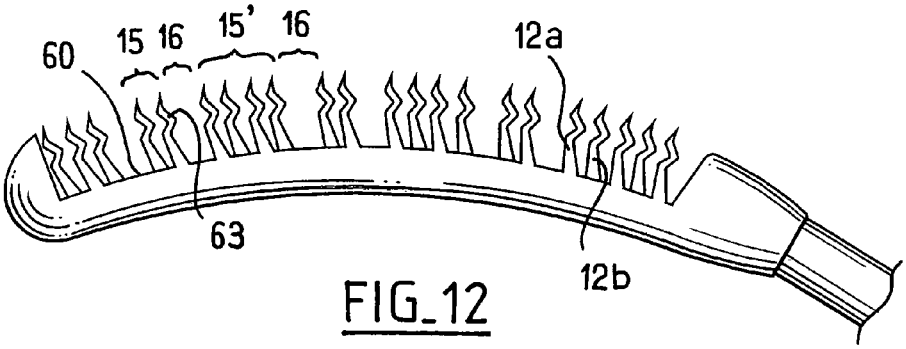

In another example, FIG. 12 shows projecting elements having angular zones 63. In this example, it is shown that the face 60 of the support to which the projecting elements are connected may be of a non-planar shape. For example, the face may be outwardly convex or outwardly concave (not shown).

Figure 13:
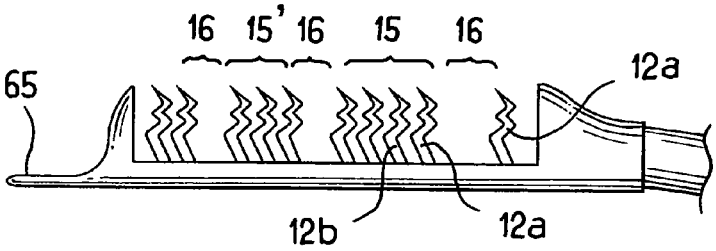

The projecting elements may serve to separate the eyelashes. Furthermore, the applicator element may also comprise, as shown in FIG. 13, at least one tip 65 enabling a line to be drawn on the eyelids. This figure also shows that a gap 16 may be formed between a group 15 of projecting elements and an isolated projecting element 12*a*.

Figure 14:
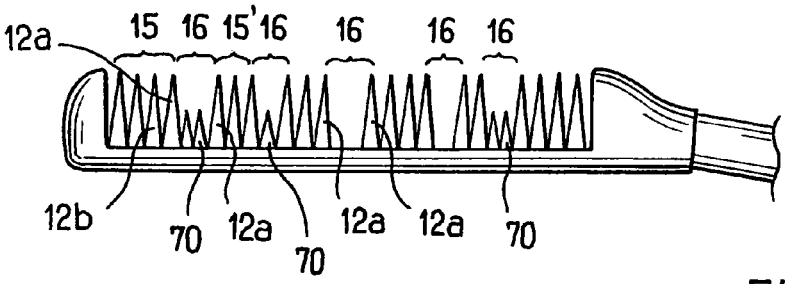

In another embodiment, the gap 16 between two adjacent projecting elements 12*a* may belong to different groups 15 and 15' that have no portions in relief. In the alternative, however, the gap 16 may include at least one portion in relief 70 suitable for retaining makeup. An example of such an exemplary embodiment is shown in FIG. 14. The relief portions 70 may have shapes differing from the projecting elements in an adjacent group, and in various exemplary embodiments, may have a shape similar to the one or more short teeth shown in FIG. 15. The relief portions 70 may be relatively unsuitable for separating eyelashes passing between the adjacent projecting elements 12*a*.

Figure 15:
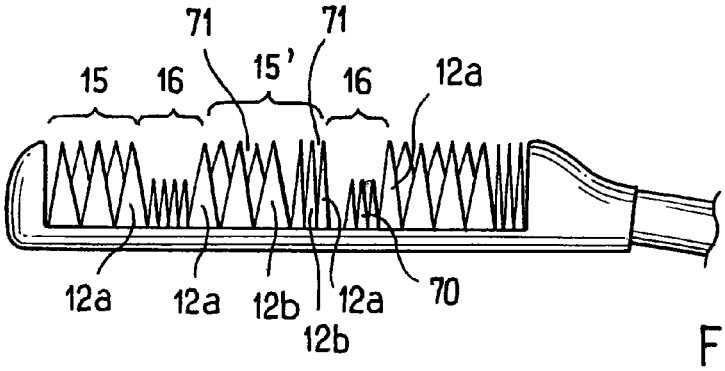

FIG. 15 depicts an exemplary embodiment which shows that within a given group of projecting elements, the projecting elements may have differing shapes. The projecting elements of at least one group may comprise both broad teeth and narrower teeth, where the individual teeth may be defined or differentiated from each other by pairs of grooves 71 that may be substantially V-shaped. FIG. 15 additionally shows that a gap 16 may have relief portions 70 along only a fraction of the support.

Figure 16:
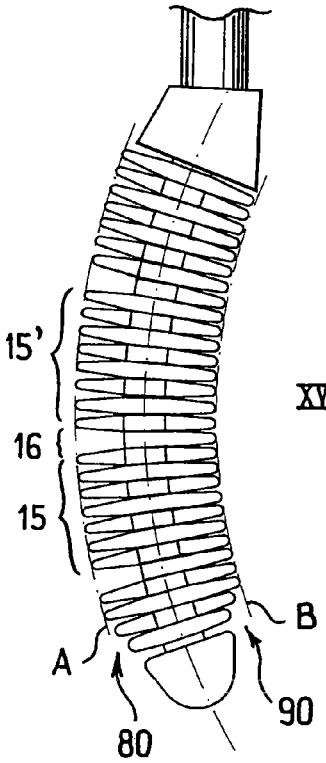

The applicator element may have more than one row of projecting elements. For example, the applicator element may have two successions of projecting elements, as shown in FIG. 16. The applicator element may comprise a first succession 80 of projecting elements and a second succession 90 of projecting elements that may be substantially opposite to the first succession. When the applicator element is observed from the side, at least some of the projecting elements of the first succession 80 may have free ends that are situated substantially along a first line A that is generally convex, and at least some of the projecting elements of the second succession 90 may have free ends situated substantially along a second line B that is generally concave. The projecting elements of the first succession 80 may be used, for example, to make up the eyebrows and/or the eyelashes, while the projecting elements of the second succession 90 may be used to make up the eyelashes.

As shown in the exemplary embodiment of FIG. 16, the projecting elements of the first succession 80 may comprise at least two groups 15 and 15' separated by a gap 16 that does not have any projecting elements.

Figure 17:
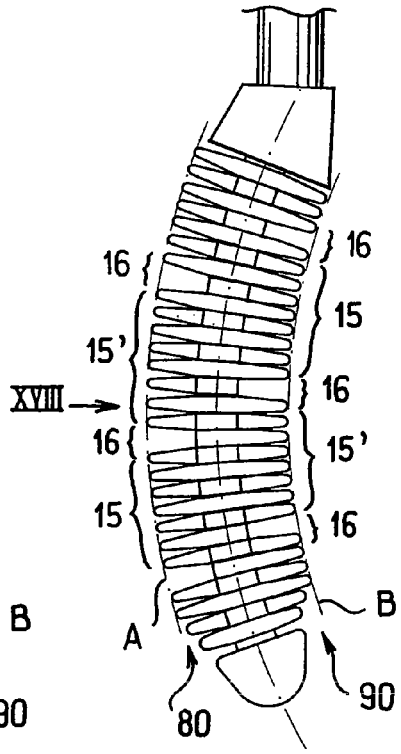
Figure 18:
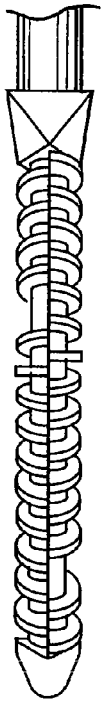

The applicator element shown in FIGS. 17 and 18 may differ from the applicator element shown in FIG. 16 by the fact that the projecting elements situated on the same side as concave line B may have at least two groups 15 and 15' separated by gaps 16.

Figure 19:
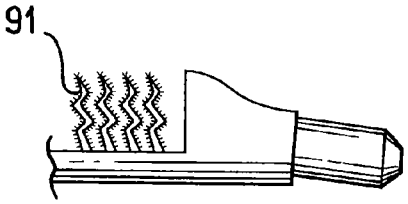

The projecting elements may be coated in flocking 91, as shown in FIG. 19.

Figure 20:
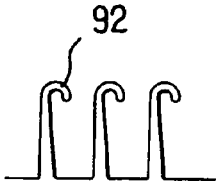
FIG. 20 is a partial schematic view of a portion of an alternative embodiment of a device.

The projecting elements may have free ends 92 that are hooked, possibly serving to catch on to eyelashes and/or eyebrows, as shown in FIG. 20.

Figure 21:
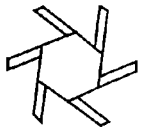
FIGS. 21-39 are partial schematic views showing respective alternative embodiments of devices.

An applicator element may comprise a plurality of rows of projecting elements which extend in the same direction of gyration when the applicator element is viewed end-on, for example, as shown in FIG. 21. Additionally, the projecting elements may be connected to the support via an extension of an adjacent face. For more details relating to applicator elements of this type, reference may be made to European patent application No. EP-A-1 070 468.

Figure 22:
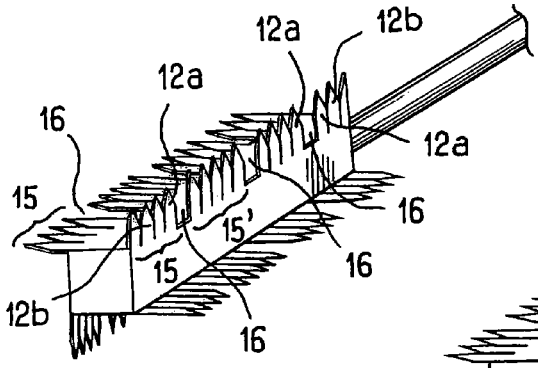

FIG. 22 depicts an exemplary embodiment of an applicator element that has a plurality of rows of projecting elements (e.g., four rows). Each row may comprise at least two groups 15 and 15' of projecting elements separated by a gap 16, the gap possibly being made in the form of a notch.

Figure 23:
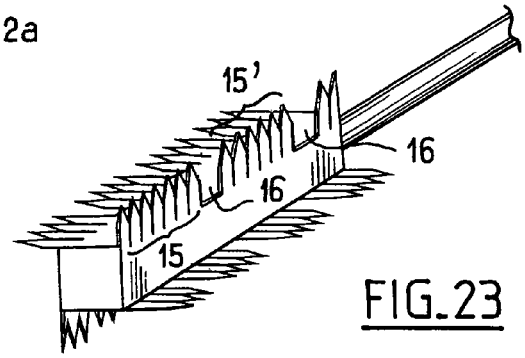

All of the rows of teeth may be substantially identical, i.e., each row may be substantially similar to an adjacent row turned about the axis of the support, as shown in the exemplary embodiment of FIG. 22. In another exemplary embodiment, as shown in FIG. 23, at least two rows may be different such that at least one gap 16 in one row may not superpose exactly with a gap 16 in another row after the support has been turned about its axis (e.g., through one-fourth of a turn). In various embodiments, the projecting elements may have oblong faces that are elongate in a direction parallel to the axis of the row.

Figure 24:
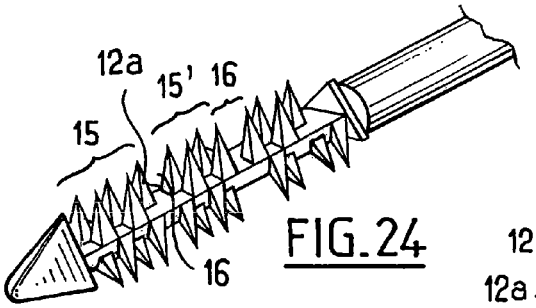

Projecting elements may be connected to the support in different ways. For example, the projecting elements may be connected to the support substantially perpendicularly to a face thereof, as shown in the exemplary embodiment of FIG. 24.

Figure 25:
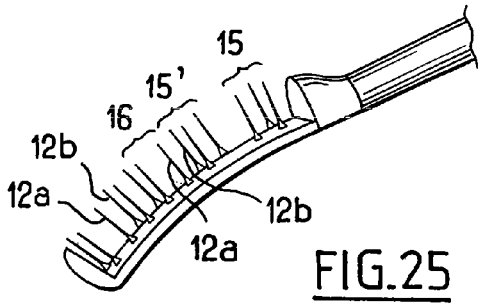

Projecting elements may have a portion that is substantially cylindrical, as shown in the exemplary embodiment of FIG. 25. For example, the projecting elements may form spike-like structures.

Figure 26:
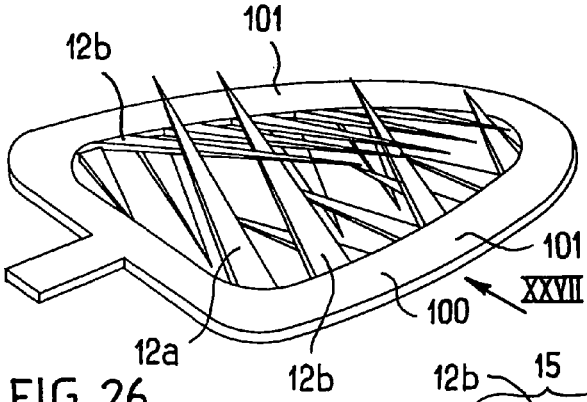
Figure 27:
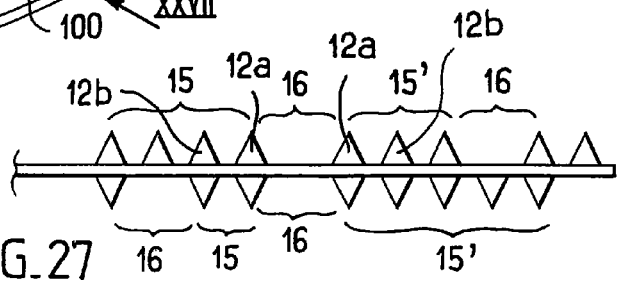

FIG. 26 depicts an exemplary embodiment of an applicator element that has a support 100 with a hole and two opposite regions 101 having projecting elements connected thereto. An example of such an embodiment is described in European patent application No. EP-A-1 169 941. FIG. 27 is a side view of the applicator element of FIG. 26 as seen along arrow XXVII.

Figure 28:
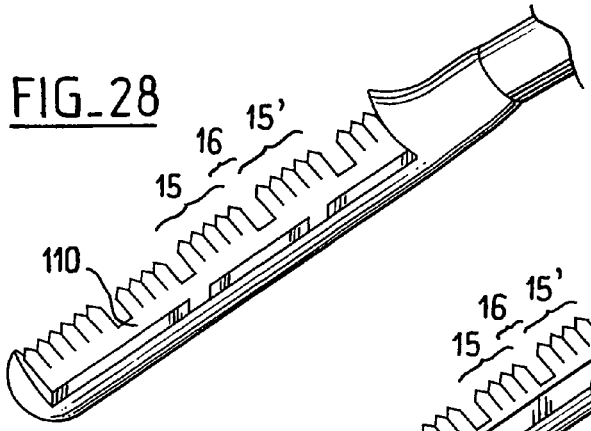
Figure 29:
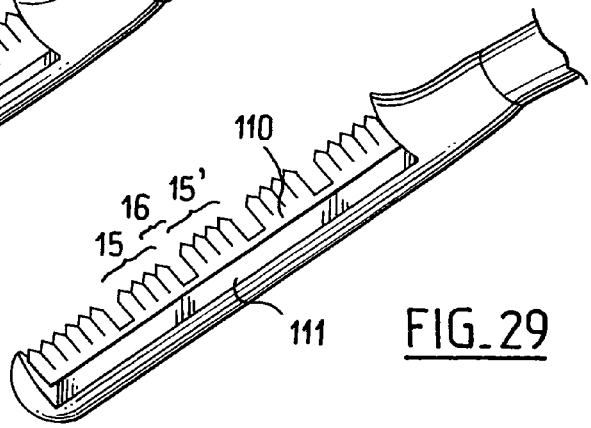

Projecting elements may also be defined, for example, by a serrated edge of a wall 110, as shown in FIG. 28. In various exemplary embodiments, the wall may connect to a support via at least a fraction of its length, as shown in FIG. 28, or may be connected only to proximal and distal portions of the support, as shown in FIG. 29. A slot 111 may be provided between the wall 110 and the support so as to enable a supply of makeup to be retained therein. Applicator elements may have projecting elements defined by the edge of a wall that is connected over all or part of its length to a support as described in European patent applications Nos. EP-A-1 157 629 and EP-A-1 157 632.

Figure 30:
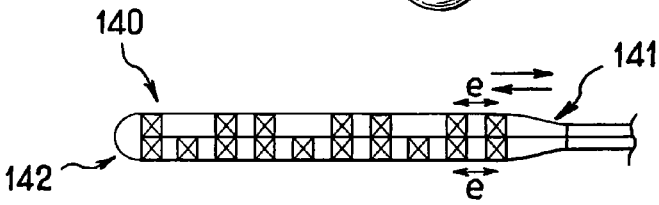
Figure 31:
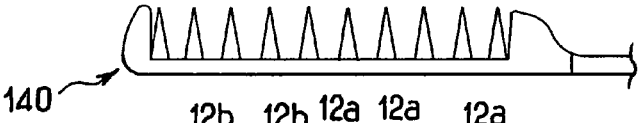
Figure 32:
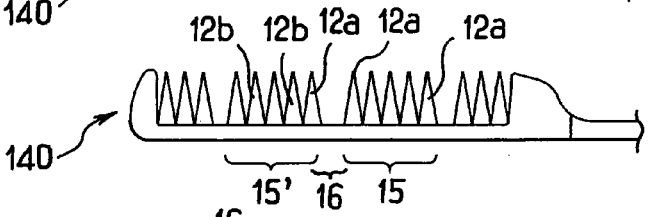

An applicator element may also have, as shown in the exemplary embodiment of FIGS. 30 to 32, a comb 140 having two portions 141 and 142 suitable for sliding relative to each other along the longitudinal axis of the comb. Each of these portions may have teeth 12*a*, 12*b*. An exemplary embodiment of the comb 140 is shown in FIG. 31 in a plan view and in FIG. 32 in a side view.

FIG. 31 shows that when the portions are in a first position relative to each other, the teeth of the portion 141 may occupy axial positions that are substantially identical to those of the teeth of the portion 142, such that when the comb is observed from the side, a single row of teeth can be seen spaced at a constant pitch.

When the portion 141 slides relative to the portion 142, the teeth on portion 141 may be offset axially relative to the teeth on portion 142 and appear between them, such that when the portions are in a second position relative to each other, as shown in FIG. 32, a row of teeth may be situated substantially in alternation on opposite sides of a geometrical separation surface.

The teeth of the portion 141 may be disposed along a surface in axial positions which are integer multiples of the spacing e between two teeth on portion 141. The same may be true for the teeth on portion 142, and additionally, the portion 142 may have more teeth than portion 141. Portions 141 and 142 may be driven by any suitable mechanism. An example of such a mechanism is shown in U.S. Pat. No. 5,086,793.

In the configuration corresponding to FIG. 32, the two portions 141 and 142 have been offset by a distance corresponding substantially to e/2.

When the projecting elements are teeth, they may have differing sizes and/or shapes. For example, the teeth may have a triangular profile with different slopes, as shown in FIGS. 33 and 34.

Figure 33:
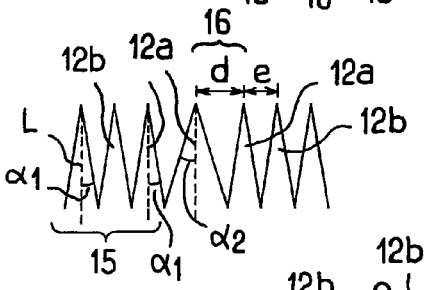
Figure 34:
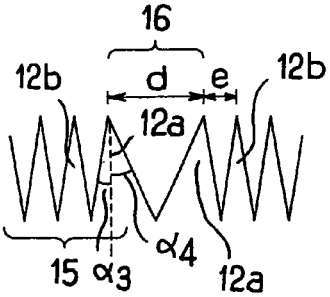

FIG. 33 depicts an exemplary embodiment of a comb where consecutive teeth 12*a*, 12*b* meet at their base portions, and do not overlap when the comb is observed from the side. The teeth may have a slope with an angle $\alpha_i$ relative to the longitudinal axis L, and may form a group 15 of projecting elements whose tips are separated from one another by a distance e. A tooth 12*a* may form a slope with an angle $\alpha_2$ (which may, for example, be greater than angle $\alpha_1$) relative to the longitudinal axis and leave a gap 16 between the tooth 12*a* and group 15. The distance d between the tip of the tooth 12*a* and the tip of the adjacent tooth in the group 15 may be greater than the distance e.

The tooth 12*a* having a slope of angle $\alpha_2$ may be symmetrical in shape relative to a midplane passing through its tip and perpendicular to the plane of FIG. 33. However, in another embodiment, the tooth may also be asymmetrical in shape.

In yet another embodiment, some of the teeth in the row may have a relatively steep slope on one side and a less steep slope on the other side.

FIG. 34 depicts another exemplary embodiment of a comb in which a tooth 12*a* at the end of a group 15 has a slope of angle $\alpha_3$ on the side adjacent to a tooth 12*b* within the group, and a slope of angle $\alpha_4$ on the side that faces out of the group. In this example, angle $\alpha_3$ may have a slope that is different from angle $\alpha_4$.

A gap 16 may be formed between two teeth 12*a* having an asymmetrical profile, for example, as shown in FIG. 34.

Figure 35:
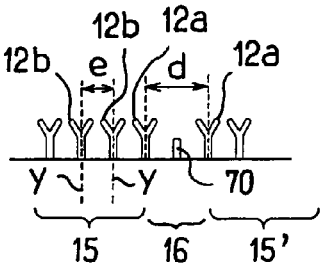

The projecting elements may also have a plurality of top free ends. For example, the projecting elements may be Y-shaped, an example of which is shown in FIG. 35. The spacing e between projecting elements within a group may be measured in a variety of ways, for example, between the centers of their base portions.

Two elements 12*a* in two groups 15 and 15' may leave a gap 16 in-between which extends over a distance d that is greater than the spacing e between two projecting elements within each group 15.

The gap 16 may contain a relief portion 70 or relief portions. The relief portions may have the same shape, for example, as the bottom portions of the projecting elements 12*a* or 12*b*. Such a relief portion may be shorter than either of the adjacent projecting elements.

In addition to teeth, tufts of bristles may also be used as projecting elements. The tufts of bristles may be fitted onto a support that is not constituted by a twisted core. An example of such an embodiment is depicted in FIGS. 36 to 39.

The tufts of bristles may be inserted into holes in the support and may be fixed therein by stamping the support, for example, as described in European patent application No. EP-A-1 155 637. Other fixing means may be used. For example, the tufts of bristles may be fixed to the support by an adhesive or by staples.

The gaps 16 formed between the groups of projecting elements may be suitable for separating the eyelashes for various reasons. Some exemplary reasons include the fact that the bristles may be totally omitted, or that the bristles may be shorter in length as compared to the projecting elements.

Figure 36:
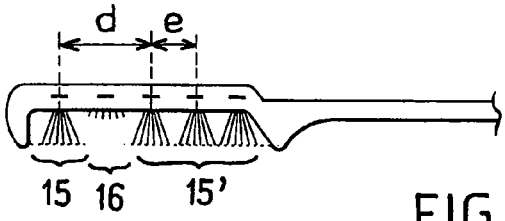
Figure 37:
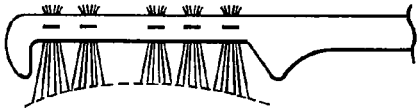
Figure 38:
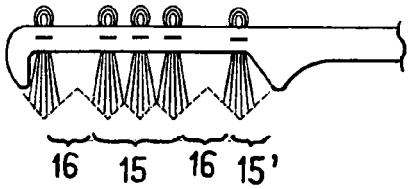
Figure 39:
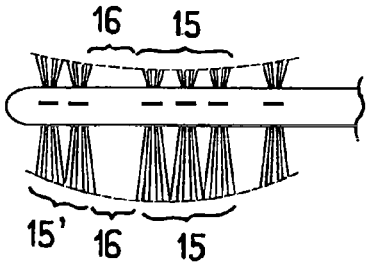

The ends of the bristles may lie on a surface that is substantially planar, for example, as shown in FIG. 36. In another exemplary embodiment, the ends of the bristles may form a shape that is generally concave as shown, for example, in FIG. 37. In additional exemplary embodiments, the ends of the bristles may form sawteeth (e.g., as shown in FIG. 38), or may be generally convex (e.g., as shown in FIG. 39).

In various exemplary embodiments, the support holes may be through holes or blind holes. The bunches of bristles may be folded into U-shapes and may be inserted into the support holes to form loops on one side of the support, for example, as shown in FIG. 38. The loops may be cut to form tufts of bristles on both sides of the support, as shown, for example, in FIG. 39.

FIGS. 36 to 39 show that the spacing e between consecutive tufts of bristles (e.g., three consecutive tufts of bristles) measured, for example, from their bases may be constant, and that each tuft of bristles may be considered a projecting element as depicted in the exemplary embodiment of FIGS. 2 to 6.

In still a further embodiment, an applicator may be used together with a receptacle provided with a wiper other than a wiper with an elastomer lip. For example, the wiper may include a perforated block of foam 130, as shown in FIG. 40.

Figure 40:
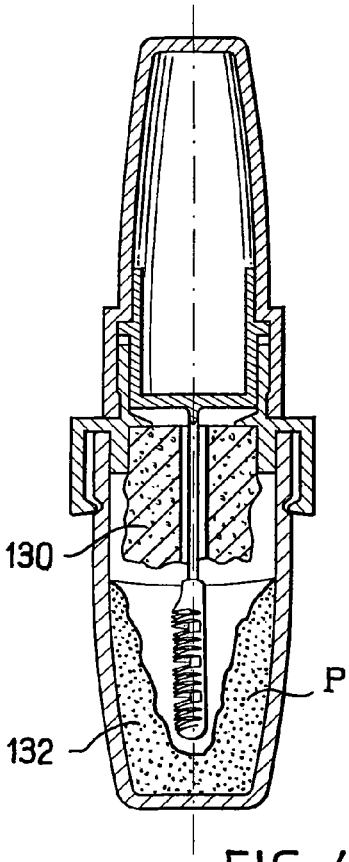
FIG. 40 is a schematic axial view of an alternative embodiment of a system.
Figure 7A:
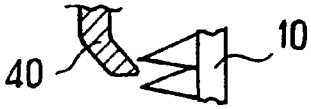
FIG. 7A is a diagrammatic view of an example of a portion of a device being wiped.
Figure 41:
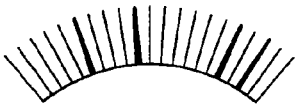
FIGS. 41-45 are schematic views showing examples of makeup effects that may be obtained by using one or more devices described herein.

In the exemplary embodiment shown in FIG. 40, the makeup P may contain fibers 132 that are to be deposited on the eyelashes and/or the eyebrows.

As shown in FIGS. 41-45, a makeup effect may be obtained in which the eyelashes and/or the eyebrow hairs are bunched together into packets.

The eyelashes may be bunched together because the gap or gaps 16 in the applicator element may become filled with a relatively large amount of makeup. The makeup in the gaps 16 may then be deposited on various groups of eyelashes without separating them because there may not be any projecting elements capable of separating the groups of eyelashes in the gaps 16. It may not be just the makeup in the gaps, however, that causes the bunching to occur. In another exemplary embodiment, the bunching together of the eyelashes may be due to the fact that when the gaps 16 are not full of makeup, the eyelashes or eyebrow hairs may become engaged therein and may be brought into contact with one another, thereby bunching them together. Accordingly, the makeup that may be present in the gaps, or may have already been applied to the eyelashes, may facilitate and/or assist in the bunching process. Once the eyelashes have been bunched together, they become difficult to separate with the combing portions of the comb.

Figure 42:
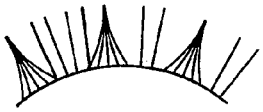

The eyelashes and/or eyebrows may also include some hairs that are completely separated between the bunches, as depicted, for example, in FIG. 42.

Figure 43:
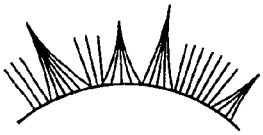

The quantity of makeup deposited on each bunch of eyelashes may be non-uniform, such that certain bunches of eyelashes may be or at least appear to be longer than others. As shown in FIG. 43, the bunches of eyelashes may also have differing numbers of eyelashes. Some of the bunches thus may appear broader or longer than others.

Figure 44:
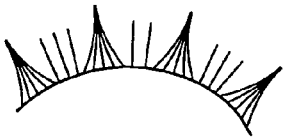

The separated eyelashes and the bunches of non-separated eyelashes may alternate in a regular or irregular manner, as depicted, for example, in FIGS. 43 and 44.

Figure 45:
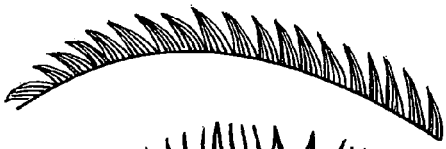
Figure 45:
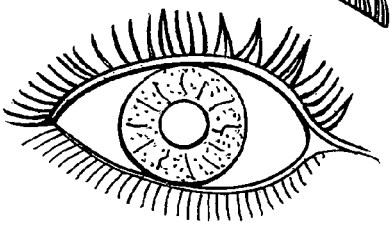

Both the eyelashes and the eyebrows may be made up so as to form bunches of hairs that are grouped together, as depicted in FIG. 45.

Other exemplary embodiments of the device enabling novel makeup effects to be obtained are described below with reference to FIGS. 46 to 49.

Figure 50:
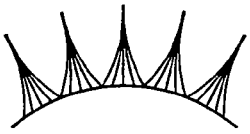
FIG. 50 is a schematic view of an example of a makeup effect that may be obtained by using one of the embodiments of FIGS. 46-49

Some exemplary embodiments of the device seek to obtain a makeup effect in which all of the eyelashes are grouped together in bunches, as depicted, for example, in FIG. 50.

Whereas in the exemplary embodiments depicted in FIGS. 1 to 45, it is shown that a device may have both zones suitable for separating eyelashes and zones suitable for bunching them together, as depicted in the exemplary embodiments of FIGS. 46 to 49, a device may also give the eyelash-bunching effect priority.

Figure 46:
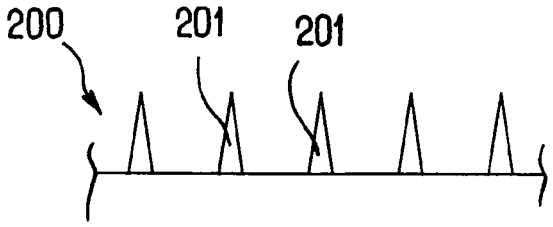
FIGS. 46-49 are partial schematic views of alternative embodiments of the device.

The comb 200 shown partially in FIG. 46 may comprise a succession of teeth 201 with a spacing in between the teeth that is large enough for a plurality of eyelashes to become engaged (e.g., bunched) between the teeth. When the plurality of eyelashes are being engaged (e.g., bunched) between the teeth, they may also be coated with makeup present between the teeth. The spacing between the teeth 201 as measured between their tips may be about 3 mm, for example, and the comb may have about ten teeth, although various embodiments may have any number of teeth.

Figure 47:
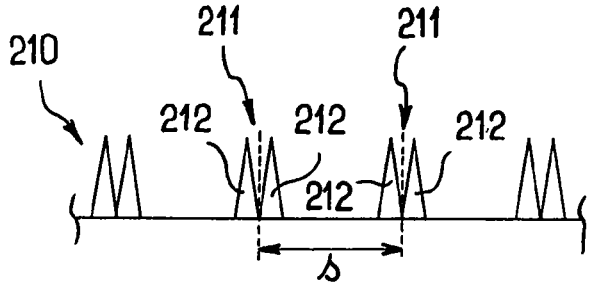

The exemplary embodiment depicted in FIG. 47 includes a comb 210 having a succession of groups 211 each made up of two teeth 212 that are very close together. For example, the spacing s between the two adjacent groups may be about 3 mm.

Figure 48:
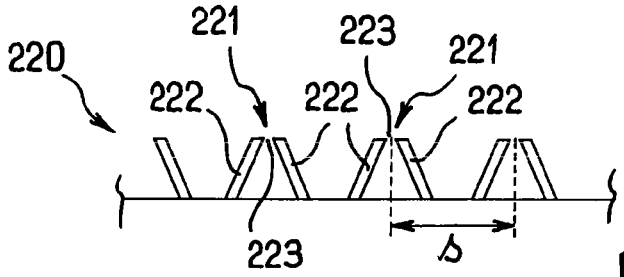
Figure 49:
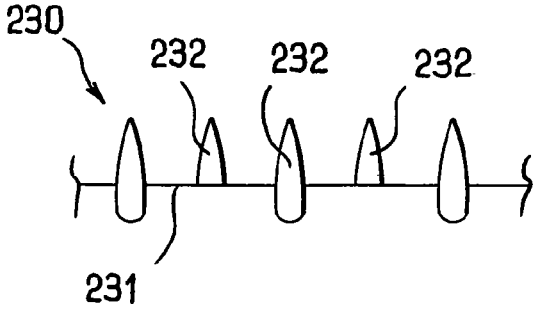

The comb 220 shown in FIG. 48 has groups 221 that each have two teeth 222 that slope obliquely towards each other. The sloping of the teeth towards each other may leave their top ends a relatively short distance 223 apart, such that the eyelashes and/or eyebrows that do not tend to become engaged with each other may become engaged between the two teeth 222 of the given group 221 when the comb coated in makeup is brought into contact with the eyelashes and/or the eyebrows.

The spacing s between the groups may, for example, be about 3 mm. FIGS. 46 to 48 show that the teeth may have bases that are aligned with a longitudinal axis of the support to which they may be connected. In various embodiments, the teeth may be disposed alternately on opposite sides of a central core, as shown, for example, in FIG. 49.

The comb 230 may have a core 231 that has two opposite faces to which teeth 232 may be connected alternately on opposite sides of the core 231.

The spacing between two adjacent teeth 232 measured parallel to the longitudinal axis of the support may, for example, be about 3 mm. As shown in the exemplary embodiments of FIGS. 46 to 49, the spacing between the teeth or groups of teeth may be regular along the support, however, the spacing may also be irregular (i.e. not be constant).

Brushes

Figure 51:
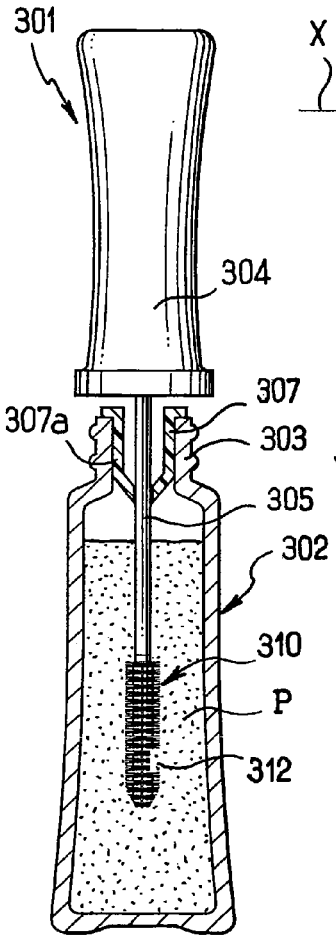
FIG. 51 is a schematic axial view of an embodiment of a system including a brush.

FIG. 51 depicts an exemplary embodiment of a system 301 including a receptacle 302 containing makeup P, the receptacle 302 possibly having with a neck 303 with an outside thread. A closure cap 304 may be fixed on the neck 303 to close the receptacle 302 in leaktight manner when it is not in use.

The device 301 may include an applicator having a rod 305, the rod possibly having at one end a cap 304 which may be used as a handle, and at the other end a brush 310.

In an exemplary embodiment, the receptacle 302 is elongate in shape, but may have any other shape.

A wiper member 307 may be fixed in the neck 303 of the receptacle 302 and may have an elastomer lip whose free edge defines a wiping orifice 307*a* that may be circular. In one such example, the wiping orifice may have a diameter that is equal to or slightly greater than the diameter of the rod 305.

The brush 310 may have a metal core 315 fixed to an end of rod 305 and may be formed by two twisted-together branches 316 of wire. Bristles 317 may be clamped between the branches 316 in conventional manner, as depicted in the exemplary embodiment of FIGS. 52 and 53.

The bristles 317 may be made of a natural or synthetic material (e.g., an elastomer) and may be flocked. In various embodiments, the brush 310 may include a mixture of different types of bristles.

In another exemplary embodiment, the brush may have have bristles that are injected or overmolded onto the core (e.g., a core made of thermoplastic material) or the core may be made integrally with the rod. In these or other embodiments, the bristles may extend radially around the core.

The brush 310 may have at least one notch 312 made by clipping the brush. In another example, if the bristles are made out of appropriate materials, the notch 312 may be made by melting or vaporizing the bristles 317.

Figure 52:
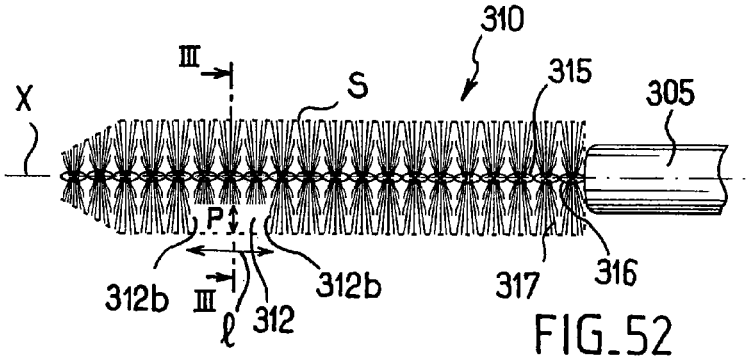
FIG. 52 is a schematic side view of the brush shown in FIG. 1.
Figure 53:
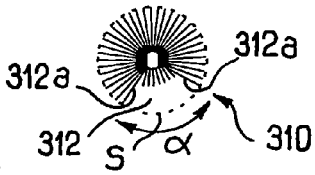
FIG. 53 is a cross-section view along line III-III of FIG. 52.

As depicted in the exemplary embodiments of FIGS. 52 and 53, the notch 312 may extend over less than one complete revolution of the brush and may also extend over only a fraction of the length of the brush, such that when viewing a cross-section in a plane intersecting the notch, the brush is substantially non-circular.

In an exemplary embodiment, the notch 312 may extend over an angular extent $\alpha$ measured around the axis X of the brush 310 and may also extend over a length l over the length of the brush. For example, the angular extent $\alpha$ may correspond to about one-fourth of the circumference of the brush 310, and the length l may correspond to about one-sixth of the length of the brush.

The notch 312 may be defined circumferentially by two faces 312*a* and axially by two faces 312*b*.

Figure 54:
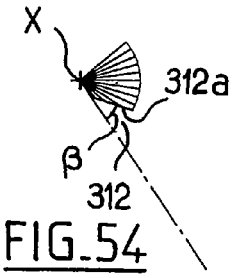
FIG. 54-57 are partial schematic views of alternative notch shapes.

The faces 312*a* may be substantially radial, as shown in the exemplary embodiment depicted in FIG. 53, or the faces 312*a* may have a non-zero angle $\alpha$ relative to a radius, as shown in the exemplary embodiment depicted in FIG. 54.

Figure 55:
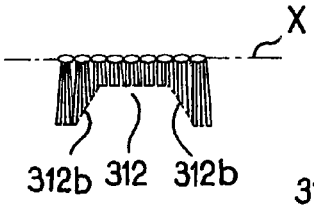

The faces 312*b* may be substantially perpendicular to the core, as shown in the exemplary embodiment depicted in FIG. 52, or the faces 312*b* may not be perpendicular thereto, as shown in the exemplary embodiment depicted in FIG. 55. For example, the faces 312*b* may diverge outwardly.

The brush 310 may define an envelope surface S that may be cylindrical about the axis X.

The distal end portion of the brush may be frustoconical, as depicted in the exemplary embodiment of FIG. 52.

Figure 56:
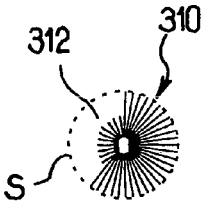
Figure 57:
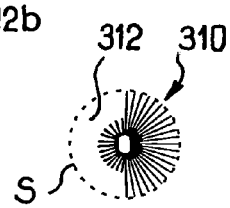

The notch 312 may extend over a fraction of the circumference of the brush 310, for example, about one fourth of the circumference of the brush. The exemplary embodiment depicted in FIG. 56 shows a notch 312 which extends over about one-third of the circumference of the brush 310, while the exemplary embodiment depicted in FIG. 57 shows a notch 312 which extends over about one-half of the circumference of the brush 310.

The length of the bristles, at least in a region of the notch, may be shorter than the length of the bristles outside the notch. For example, the length of the bristles may be substantially zero. In additional embodiments, the brush may have a circular cross-section when viewed in a plane perpendicular to the core and intersecting the notch.

Figure 58:
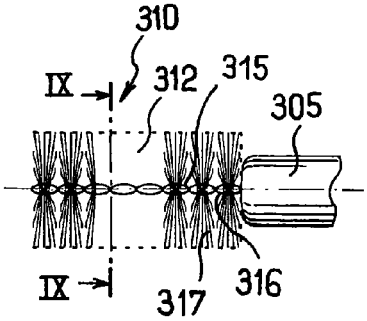
FIG. 58 is a partial schematic view of a portion of a further embodiment of a brush.

The exemplary embodiment depicted in FIG. 58 shows a portion of a brush 310 that has a notch 312 whose bottom may be defined by the core, and may also have bristles that project very little, if at all, from the two twisted-together branches 316 of the core 315. The bristles may thus be held captive by the two twisted-together branches 316 of the core 315.

Figure 59:
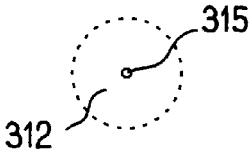
FIG. 59 is a cross-section view along line IX-IX of FIG. 58.

In a further exemplary embodiment, a notch may extend completely around the core of the brush, as shown in FIG. 59.

In another exemplary embodiment, the wiper member 307 may be configured so as to leave makeup in the notch.

Figure 60:
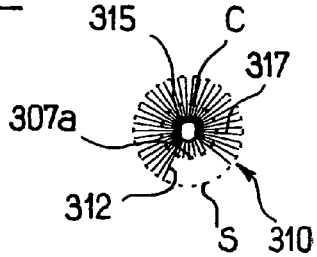
FIG. 60 is a view analogous to that of FIG. 53 showing the outline of a wiper orifice.

A dashed line, as shown in the exemplary embodiment of FIG. 60, depicts an inner outline C of the wiper orifice 307*a*.

The outline C may intersect the notch 312. The shorter bristles 317 may be situated between the core 315 and the notch 312 and may have free ends that are situated substantially inside the outline C of the wiper orifice 307*a*, such that these bristles are not wiped when the brush passes through the wiper member. As a result, the makeup P may accumulate in at least a portion of the notch 312.

In another exemplary embodiment that is not shown, the outline C may have a non-circular shape.

During application, it may be possible to deposit makeup in a manner that is non-uniform onto the eyelashes and/or the eyebrows. For example, it may be possible to deposit more makeup on the eyelashes and/or eyebrows that come into contact with the makeup present in the notch 312 than on those eyelashes and/or eyebrows that do not come into contact with the makeup present in notch 312.

The brush may have a plurality of notches 312. However, FIGS. 51 and 52 only show one notch in order to simplify the description.

Figure 61:
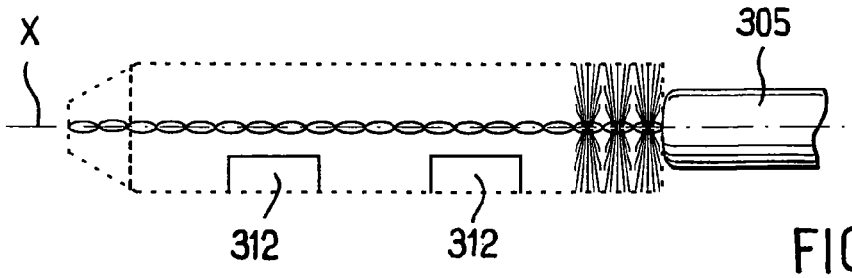
FIG. 61 is a partial schematic view of an alternative embodiment of a brush.

The notches 312 may be offset along the axis X of the brush, as shown, for example, in FIG. 61. One of the notches may be substantially similar (e.g., a mirror-image or identical) to another notch that is positioned substantially across the axis X of the brush.

Figure 62:
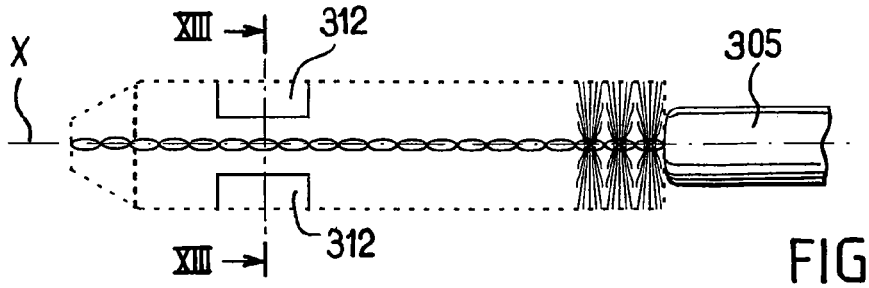
FIG. 62 is a partial schematic view of a portion of an alternative embodiment of a brush.

A plurality of notches 312 (e.g., at least two notches) may be offset circumferentially (in addition to, or rather than, being offset axially), as depicted in the exemplary embodiment of FIG. 62.

Figure 63:
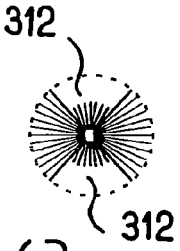
FIG. 63 is a cross-section view along line XIII-XIII of FIG. 62.

A plurality of notches 312 (e.g., at least two notches) may be distributed around the circumference of the brush 310 in such a manner as to be diametrically opposite to each other, as shown in the exemplary embodiment of FIG. 63.

Figure 64:
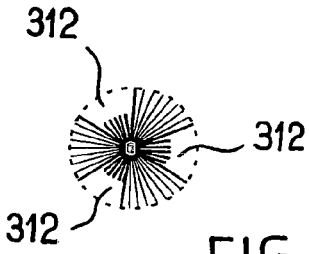
FIGS. 64-67 are views similar to that of FIG. 63 showing respective alternative embodiments.

The brush may also have a plurality of notches 312 disposed at substantially regular angular intervals around the circumference. For example, in the exemplary embodiment depicted in FIG. 64, three notches are disposed at substantially 120° intervals. Alternatively, there could be a larger number of notches.

Figure 65:
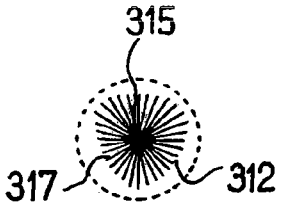

The exemplary embodiment depicted in FIG. 65 shows that a notch may extend completely around the core 315.

If the bristles are not very short, the cross-section of the brush may have a non-circular shape. For example, the cross-section may have a shape that is substantially triangular, as depicted in FIG. 65. In this figure, a dashed line shows the section of the envelope surface of the brush outside the notch. Bristle§ whose ends define the bottom of the notch may have different lengths on different portions disposed around the core.

Figure 66:
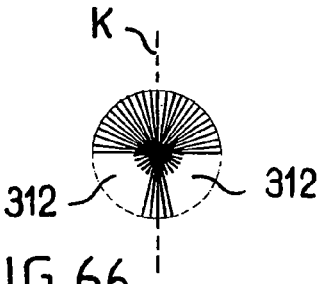
Figure 67:
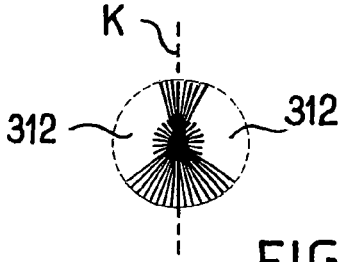

FIGS. 66 and 67 show that a brush may have at least two notches 312 disposed substantially symmetrically relative to each other about a midplane K containing the axis X of the brush.

The two notches 312 may be separated in the circumferential direction, in a first example by a first set of bristles which may extend over a portion of the circle (e.g. a semicircle as shown in FIG. 66 or one-third of the circle as shown in FIG. 67), and in a second example by a set of bristles which may occupy a smaller angular extent.

Figure 68:
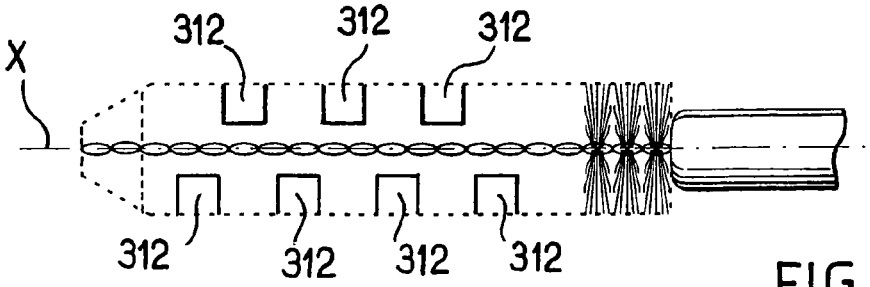
FIG. 68 is a partial schematic side view of an alternative embodiment of a brush.

In the exemplary embodiment depicted in FIG. 68, when the brush is observed in side view or in longitudinal section, it may have notches that are disposed in a staggered configuration. In addition to the exemplary embodiment depicted in FIG. 68, however, the notches 312 may have a variety of configurations. For example, the brush may have a plurality of series of notches (e.g. at least two series of notches). The notches in each series may be offset circumferentially, radially, and/or axially relative to the notches in the other series. For example, the plurality of series of notches may be substantially similar (e.g., identical) to each other, except that they may have been shifted relative to each other in a line parallel to the axis of the brush.

Some exemplary embodiments may have notches that are identical in shape, however, other exemplary embodiments may have a plurality of notches that are not identical in shape. For example, some notches on a brush may have a different shapes from other notches on the brush that are offset axially and/or circumferentially.

Figure 69:
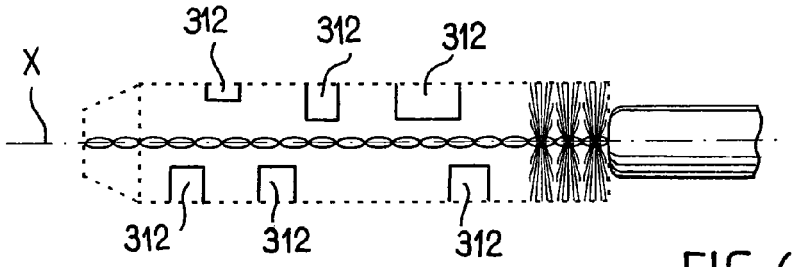
FIG. 69 is a partial schematic side view of an alternative embodiment of a brush.

An exemplary embodiment of a brush that has notches of differing shapes is shown in FIG. 69. The depth p of the notches may vary from one notch to another, and similarly the length l of the notches as measured parallel to the axis X of the brush may vary from one notch to another. The spacing between notches may also vary.

The brush may also define an envelope surface that is not substantially cylindrical.

Figure 70:
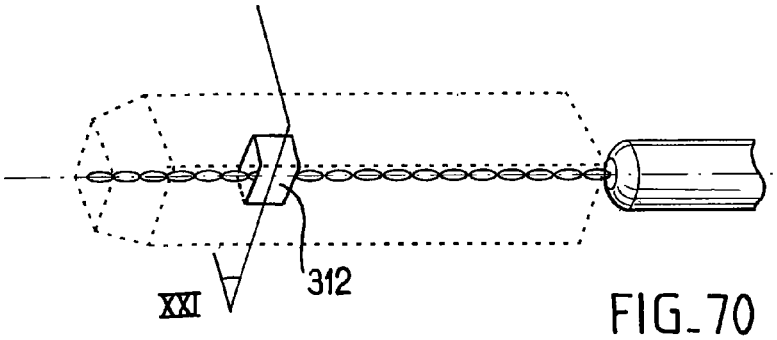
FIG. 70 is a partial schematic view of an alternative embodiment of a brush.
Figure 71:
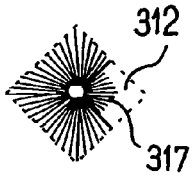
FIG. 71 is a cross-section view along plane XXI-XXI of FIG. 70.

The exemplary embodiment depicted in FIG. 70 shows a brush having an envelope surface, for example, in the shape of a polygon. In an exemplary embodiment, FIG. 71 shows an envelope surface in the shape of a square. Additionally, the brush may have, for example, at least one notch 312 that occupies a volume adjacent to one of the edges of the envelope surface.

Figure 72:
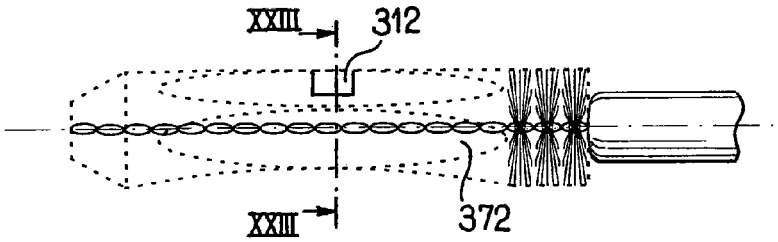
FIG. 72 is a partial schematic side view of an alternative embodiment of a brush.
Figure 73:
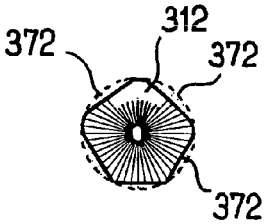
FIG. 73 is a cross-section view along line XXIII-XXIII of FIG. 72.

The brush may have at least one notch made in a portion of the brush that is not constant (i.e., irregular) as one moves along a line that is parallel to its axis. An example of such a brush embodiment is shown in FIGS. 72 and 73.

As shown in the exemplary embodiment, the brush may have concave faces 372 that together may define ridge surfaces belonging to an envelope surface that may be substantially cylindrical in shape.

Each face 372 may have a width that may have a maximum as one moves along the brush from one end of the notch to the other.

In various embodiments, the brush may have at least one notch 312 in various configurations on various faces. The notch may be made, for example, between two faces 372 as depicted in FIG. 73, or may be made on one face 372 and define a region, with a greater depth, within the face.

Figure 74:
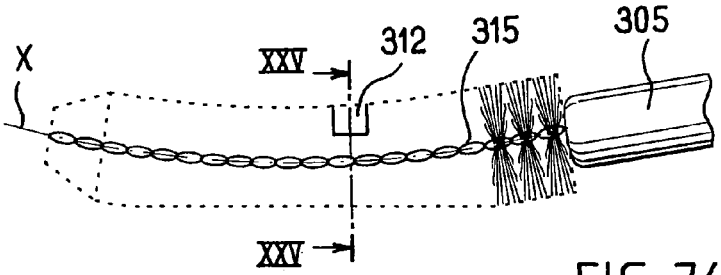
FIG. 74 is a partial schematic side view of an alternative embodiment of a brush.
Figure 75:
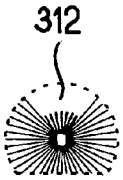
FIG. 75 is a cross-section view along line XXV-XXV of FIG. 74.

The brush may present an axis X that is not rectilinear, as depicted in FIGS. 74 and 75. In another embodiment, the core 315 may make an angle relative to the axis of the rod that increases on approaching the distal end of the brush.

In still further embodiments, the brush may have at least one notch 312 on the concave side of the core, and/or the brush may have at least one notch 312 on the convex side of the core.

Figure 76:
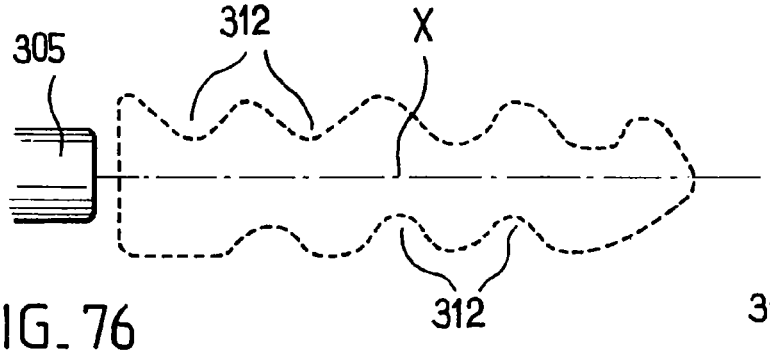
FIG. 76 is a partial schematic view of an envelope surface of a brush according to an alternative embodiment.
Figure 77:
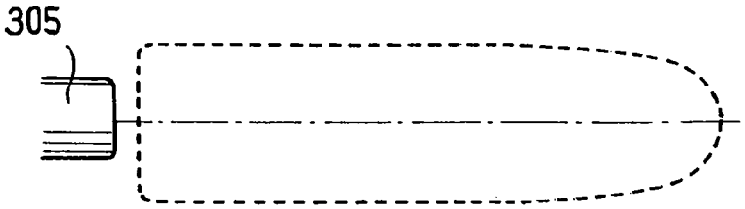
FIG. 77 is a partial schematic view of a portion of the brush of FIG. 76 after the brush has been turned one-fourth of a turn about its axis.

FIGS. 76 and 77 show an example of an envelope disposed on a brush.

As depicted in the exemplary embodiment of FIG. 77, the brush may appear to have no notches when observed in a direction perpendicular to its axis.

However, after turning the brush about one-fourth of a turn about its axis, the same brush may reveal notches. For example, the succession of notches may open out alternately on opposite (e.g., top and bottom) edges, even though the brush in question may not have a helical groove.

Figure 78:
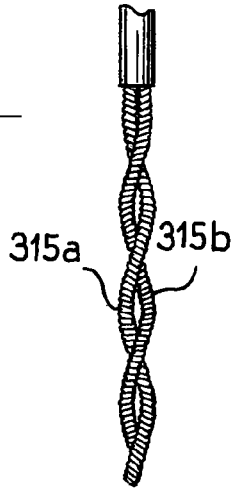
FIG. 78 is a partial schematic view of an alternative core for a brush, wherein the core includes two individual cores twisted together.

The brush may lack a core 315 made out of two twisted-together branches of wire. For example, the exemplary embodiment of FIG. 78 depicts a core obtained by winding two individual cores 315*a* and 315*b* about each other so as to obtain a twist. Individual cores 315*a* or 315*b*, however, may be made in a conventional manner by twisting together two wire branches. The two branches may hold captive between them bristles which extend radially around the core.

The notch or notches of the brush may be made by clipping the brush. In various embodiments, the clipping of the brush may be done either before or after changing the shape of the core (e.g., deforming the core). The notch or notches may also be made by melting the bristles, for example, by exposing them to laser radiation or by bringing them into contact with any type of heating element. In such an exemplary embodiment, the bristle material may be selected so as to enable the bristles to melt upon coming into contact with the heating element.

The brush may be made using bristles of different lengths and/or a mixture of different types of bristles.

The bristles used may have a variety of flexibilities and cross-sections. For example, the cross-sections may be circular or non-circular.

The notch or notches on the brush may enable makeup P to be stored when the brush is extracted from the receptacle. The wiper member, that may be disposed on the receptacle, may be configured so as to avoid wiping off all of the makeup that may initially be in a notch. When an example of such a brush is observed as it goes through the wiper orifice, at least some of a notch may be sufficiently offset at a distance from the edge of the wiper orifice so that the makeup that may be in the at least a portion of the notch may not wiped off and retained in the receptacle by the wiper member.

Figure 79:
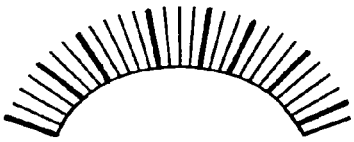
FIGS. 79-81 are schematic views showing examples of makeup effects than may be obtained by using embodiments disclosed herein.
Figure 80:
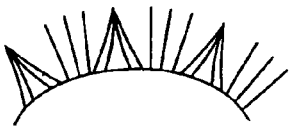
Figure 81:
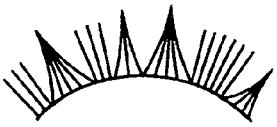

FIGS. 79 to 81 show that when the brush is brought into contact with the eyelashes and/or the eyebrows, the eyelashes that engage in the notch may become coated in makeup without being separated, such that the brush makes it possible to obtain a makeup effect in which the eyelashes are grouped together in bunches.

FIG. 79 shows that certain eyelashes and/or bunches of eyelashes (e.g., those that have engaged in a notch) may carry more makeup than other eyelashes and/or bunches of eyelashes.

The makeup effect obtained may comprise bunches of eyelashes with separated eyelashes being disposed between them in relatively uniform manner, as shown in FIG. 80, or in irregular manner, as shown in FIG. 81.

The invention is not limited to the embodiments described above, and it may be possible to combine the characteristics of the various embodiments with one another.

Throughout the description, including the claims, the expression "a" should be understood as being synonymous with "at least one" (i.e., relating to both the singular and the plural) unless otherwise specified to the contrary.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A brush for applying makeup to eyelashes and/or eyebrows, the brush comprising:

a core;

bristles comprising end portions extending substantially radially around at least a portion of the core, wherein the bristles define a bristled portion of the brush having a first length measured along a longitudinal axis of the core; and at least one notch having a second length measured along the longitudinal axis of the core less than half the first length, the at least one notch defined at a notched bristled portion of the brush, wherein the bristles further define a non-notched bristled portion that is devoid of any notch all around the core along the non-notched bristled portion of the brush, wherein the brush has a non-circular cross-section in a plane perpendicular to the core and intersecting the notch, and wherein the at least one notch is configured to form at least one bunch of eyelashes and/or eyebrows that are not separated from one another when the brush is used to apply makeup thereto.

2. The brush of claim 1, wherein the brush comprises a plurality of notches along the length of the brush, and wherein at least some of the plurality of notches face in substantially the same direction.

3. The brush of claim 1, wherein the notch does not extend all the way around the core of the brush.

4. The brush of claim 1, wherein the notch extends around the core for angles that range from 200° to 2000°.

5. The brush of claim 1, wherein the notch extends over a circumferential dimension that is greater than its axial dimension.

6. The brush of clam 1, wherein the notch extends along the brush over a length that ranges from 1.5 mm to 6.5 mm.

7. The brush of claim 1, wherein the notch has a maximum depth which ranges from 2.5 mm to 4 mm.

8. The brush of claim 1, wherein the notch extends over less than 4/10ths of the length of the portion of the brush carrying bristles.

9. The brush of claim 1, wherein the volume defined by the notches is less than the volume defined by the envelope of the brush outside the notches.

10. The brush of claim 1, wherein the brush has notches configured such that in one view, the brush appears to have no notches when the brush is viewed in a first orientation relative to the direction of observation, and when the brush is viewed in a second orientation relative to the same direction of observation, the brush appears to have notches disposed substantially in alternation on the top and bottom edges of the brush, the second orientation being obtained by turning the brush about the axis of the core through one-fourth of a turn away from the first orientation.

11. A system comprising:

the brush of claim 1; and makeup to be applied to the eyelashes and/or the eyebrows.

12. The system of claim 11, further comprising a receptacle containing the makeup.

13. The system of claim 12, wherein the system is configured so as to permit the brush to be passed into the receptacle.

14. The system of claim 12, further comprising a handle element associated with the brush, wherein the handle element comprises a closure for the receptacle.

15. The system of claim 12, further comprising a wiper member associated with the receptacle.

16. The system of claim 15, wherein the wiper member is configured to leave makeup in the notch.

17. The system of claim 15, wherein the wiper member defines a wiper orifice of a circular outline.

18. A method of making up eyelashes and/or eyebrows, the method comprising:

providing the brush of claim 1;

applying makeup to eyelashes and/or eyebrows; and combing the eyelashes and/or the eyebrows using the brush, so as to form groups of non-separated eyelashes and/or eyebrows.

19. The method of claim 18, wherein the makeup is applied using the brush.

20. The method of claim 18, wherein the makeup comprises mascara.

21. The method of claim 20, wherein the makeup is applied to the eyelashes and the eyelashes are combed.

22. A method of making up eyelashes and/or eyebrows, the method comprising:

providing the brush of claim 1;

loading the brush with makeup, the makeup being present in the notch; and applying the makeup to eyelashes and/or eyebrows using the brush, so as to form at least one group of at least two non-separated eyelashes and/or eyebrows.

23. The method of claim 22, wherein groups of non-separated eyelashes and/or eyebrows are formed.

24. The method of claim 22, wherein the makeup comprises mascara.

25. The method of claim 22, wherein the makeup is applied to the eyelashes.

26. A method of applying makeup to eyelashes and/or eyebrows, the method comprising:

loading a brush with makeup, wherein the brush comprises bristles defining a bristled portion of the brush having a first length measured along a longitudinal axis of the core, and wherein the brush comprises at least one notch in which the makeup accumulates, the notch having a second length measured along the longitudinal axis of the core less than half the first length, the at least one notch defined at a notched bristled portion of the brush, wherein the bristles further define a non-notched bristled portion that is devoid of any notch all around the core along the non-notched bristled portion of the brush; and applying makeup contained in the notch to eyelashes and/or eyebrows in such a manner as to form at least one group of non-separated eyelashes and/or eyebrows.

27. The method of claim 26, wherein the makeup comprises mascara.

28. The method of claim 26, wherein groups of non-separated eyelashes and/or eyebrows are formed.

29. The method of claim 26, wherein the makeup is applied to the eyelashes.

30. A method of making the brush of claim 1, comprising forming at least one notch in the brush by melting bristles present in the portion that is to form the notch.

* * * * *